US011107403B2

(12) United States Patent
Kato

(10) Patent No.: US 11,107,403 B2
(45) Date of Patent: Aug. 31, 2021

(54) CURRENT LIMITING CIRCUIT, DISPLAY DEVICE, AND CURRENT LIMITING METHOD

(71) Applicant: JOLED INC., Tokyo (JP)

(72) Inventor: Toshiyuki Kato, Tokyo (JP)

(73) Assignee: JOLED INC., Tokyo (JP)

( * ) Notice: Subject to any disclaimer, the term of this patent is extended or adjusted under 35 U.S.C. 154(b) by 0 days.

(21) Appl. No.: 17/027,090

(22) Filed: Sep. 21, 2020

(65) Prior Publication Data

US 2021/0090499 A1 Mar. 25, 2021

(30) Foreign Application Priority Data

Sep. 24, 2019 (JP) ..... JP2019-172798
Oct. 9, 2019 (JP) ..... JP2019-186111

(51) Int. Cl.
*G09G 3/3233* (2016.01)

(52) U.S. Cl.
CPC ... *G09G 3/3233* (2013.01); *G09G 2320/0233* (2013.01); *G09G 2320/0276* (2013.01); *G09G 2330/021* (2013.01); *G09G 2340/14* (2013.01)

(58) Field of Classification Search
None
See application file for complete search history.

(56) References Cited

U.S. PATENT DOCUMENTS

| | | | | |
|---|---|---|---|---|
| 8,829,820 | B2 * | 9/2014 | Roberts | H05B 45/20 315/309 |
| 9,894,313 | B1 | 2/2018 | Kato | |
| 2005/0052364 | A1 | 3/2005 | Otawara et al. | |
| 2010/0085285 | A1 * | 4/2010 | Ozawa | H04N 5/142 345/77 |
| 2016/0307490 | A1 * | 10/2016 | Lee | G09G 3/2022 |
| 2018/0061310 | A1 | 3/2018 | Sako et al. | |
| 2019/0066593 | A1 * | 2/2019 | Ishii | G09G 3/3258 |

FOREIGN PATENT DOCUMENTS

| | | |
|---|---|---|
| JP | 2005-257728 | 9/2005 |
| JP | 2007-212644 | 8/2007 |
| JP | 4084262 | 4/2008 |
| JP | 2018-025619 | 2/2018 |
| JP | 2018-036505 | 3/2018 |

* cited by examiner

*Primary Examiner* — Dorothy Harris
(74) *Attorney, Agent, or Firm* — Greenblum & Bernstein, P.L.C.

(57) ABSTRACT

A current limiting circuit includes: a gain calculation circuit which calculates a screen power value based on pixel values and calculates a gain based on the screen power value; and a gain multiplication circuit which multiplies the pixel values by the gain, and when a maximum value of the pixel values exceeds a first threshold value, the gain calculation circuit calculates the screen power value by use of a common pixel value greater than or equal to the maximum value instead of the pixel values, and when the screen power value exceeds a control target power value, the gain calculation circuit sets the gain to a ratio of the control target power value with respect to the screen power value, and when the screen power value is less than or equal to the control target power value, the gain calculation circuit sets the gain to 1.

14 Claims, 24 Drawing Sheets

CURRENT LIMITING CIRCUIT, DISPLAY DEVICE, AND CURRENT LIMITING METHOD

CROSS REFERENCE TO RELATED APPLICATIONS

The present application is based on and claims priority of Japanese Patent Application No. 2019-172798 filed on Sep. 24, 2019, and Japanese Patent Application No. 2019-186111 filed on Oct. 9, 2019. The entire disclosure of the above-identified applications, including the specification, drawings and claims are incorporated herein by reference in its entirety.

FIELD

The present disclosure relates to a current limiting circuit which limits a current supplied to a plurality of pixels included in a display panel, a display device, and a current limiting method.

BACKGROUND

Display devices, such as organic electroluminescent (EL) display devices, with pixels each including a self-light-emitting element have been conventionally developed. There have been demands on such display devices for upsizing a display panel. Following the upsizing of the display panel, power consumed in the display device increases. Thus, a technology of suppressing the power consumption in a display device is known (see Patent Literature 1 (PTL 1)). In the display device disclosed in PTL 1, a value of the power consumption in a display panel is calculated for each horizontal period (horizontal synchronization period)based on a video signal and a current supplied to each pixel of the display panel is limited based on results of the calculation to thereby control the power consumption of the display panel. Consequently, attempts are made to suppress the value of the power consumption in the display panel at a value less than or equal to a control target power value in the display device disclosed in PTL 1.

CITATION LIST

Patent Literature

PTL 1: Japanese Unexamined Patent Application Publication No. 2007-212644

SUMMARY

Technical Problem

In the display device disclosed in PTL 1, gamma characteristics (that is, characteristics of luminance with respect to a pixel value) provided in single color displaying (displaying in a single color) with a single red (R) color, a single green (G) color or a single blue (B) color are identical to gamma characteristics provided in white displaying (displaying in white) in small area video displaying (displaying a video on a small area of the screen) (that is, in a state in which the number of pixels which provide black displaying (displaying in black) is large). However, in large area video displaying (displaying a video on a large area of the screen) (that is, in a state in which the number of pixels which do not provide black displaying is large), gamma characteristics provided in the single color displaying is not identical to gamma characteristics provided in the white displaying. Thus, the user has discomfort with the luminance of a video displayed in the display device in the large area video displaying.

Moreover, provided in the display device disclosed in PTL 1 are the same gamma characteristics (that is, characteristics such that the luminance is proportional to the power of 2.2 of the pixel value) in the small area video displaying (that is, in the state in which the number of pixels which provide black displaying is large) as those of a display device, such as a conventional liquid crystal display device, in which each pixel does not include a self-light-emitting element. However, the current supplied to the self-light-emitting element of each pixel is limited when the pixel value of each pixel is large in the large area video displaying (that is, in the state in which the number of pixels which do not provide black displaying is large), which therefore reduces a change in the luminance with respect to the pixel value. For example, in the display device disclosed in PTL 1, the luminance is constant when the pixel value is large in the large area video displaying. Thus, the display device disclosed in PTL 1 can not necessarily display a video with the luminance faithfully reflecting the video signal in the large area video displaying.

The present disclosure has been made in view of the problem described above, and it is an object of the present disclosure to provide a current limiting circuit, etc. capable of improving gamma characteristics. More specifically, one example of an object of the present disclosure is to provide a current limiting circuit, etc. capable of providing the same gamma characteristics for black displaying and white displaying even in large area video displaying. Moreover, another example of the object of the present disclosure is to provide a current limiting circuit, etc. capable of bringing gamma characteristics provided in large area video displaying closer to gamma characteristics provided in small area video displaying.

Solution to Problem

To address the object described above, a current limiting circuit according to one aspect of the present disclosure limits a current supplied to a plurality of pixels included in a display panel, which displays a video based on a video signal, to control a power consumption value in the plurality of pixels to be less than or equal to a control target power value, in which each of the plurality of pixels includes a plurality of sub-pixels and each of the plurality of sub-pixels includes a self-light-emitting element, wherein the current limiting circuit includes: a gain calculation circuit which calculates a screen power value related to the power consumption value based on pixel values of the video signal respectively corresponding to the plurality of sub-pixels and calculates a gain based on the screen power value; and a gain multiplication circuit which multiplies the pixel values respectively corresponding to the plurality of sub-pixels by the gain, when a maximum value of the pixel values respectively corresponding to the plurality of sub-pixels in each of the plurality of pixels exceeds a first threshold value, the gain calculation circuit calculates the screen power value by use of a common pixel value greater than or equal to the maximum value instead of the pixel values respectively corresponding to the plurality of sub-pixels, and when the screen power value exceeds the control target power value, the gain calculation circuit sets the gain to a ratio of the control target power value with respect to the screen power value, and when the screen power value is less than or equal to the control target power value, the gain calculation circuit sets the gain to 1.

To address the object described above, a display device according to another aspect of the present disclosure includes: the current limiting circuit; and the display panel.

To address the object described above, a current limiting method according to still another aspect of the present disclosure limits a current supplied to a plurality of pixels included in a display panel, which displays a video based on a video signal, to control a power consumption value in the plurality of pixels to be less than or equal to a control target power value, in which each of the plurality of pixels includes a plurality of sub-pixels and each of the plurality of sub-pixels includes a self-light-emitting element, wherein the current limiting method includes: power calculation for calculating a screen power value related to the power consumption value based on pixel values of the video signal respectively corresponding to the plurality of sub-pixels; gain calculation for calculating a gain based on the screen power value; and gain multiplication for multiplying the pixel values respectively corresponding to the plurality of sub-pixels by the gain, in the power calculation, when a maximum value of the pixel values respectively corresponding to the plurality of sub-pixels in each of the plurality of pixels exceeds a first threshold value, instead of the pixel values respectively corresponding to the plurality of sub-pixels, a common pixel value greater than or equal to the maximum value is used to calculate the screen power value, and in the gain calculation, when the screen power value exceeds the control target power value, the gain is set to a ratio of the control target power value with respect to the screen power value, and when the screen power value is less than or equal to the control target power value, the gain is set to 1.

To address the object described above, a current limiting circuit according to still another aspect of the present disclosure limits a current supplied to a plurality of pixels included in a display panel, which displays a video based on a video signal, to control a power consumption value in the plurality of pixels to be less than or equal to a control target power value, in which each of the plurality of pixels includes a self-light-emitting element, wherein the current limiting circuit includes: a gain determination circuit which calculates a screen power value related to the power consumption value based on pixel values of the video signal respectively corresponding to the plurality of pixels and determines a gain based on the screen power value; and a gain multiplication circuit which multiplies the pixel values respectively corresponding to the plurality of pixels by the gain, where the screen power value provided when a current corresponding to an upper limit value of the pixel values respectively corresponding to the plurality of pixels has been supplied is defined as a rated power value, a ratio of the screen power value with respect to the rated power value is defined as a screen power ratio, and a ratio of the control target power value with respect to the rated power value is defined as a target power ratio, the gain determined by the gain determination circuit is 1 when the screen power ratio is less than or equal to a first power ratio less than the target power ratio, the gain monotonously decreases with respect to the screen power ratio when the screen power ratio is greater than the first power ratio and less than or equal to 100%, the gain is a value less than a value obtained by dividing the target power ratio by the screen power ratio when the screen power ratio is greater than or equal to the target power ratio and less than 100%, and the gain is the target power ratio when the screen power ratio is 100%.

To address the object described above, a display device according to still another aspect of the present disclosure includes: the current limiting circuit described above; and the display panel.

To address the object described above, a current limiting method according to still another aspect of the present disclosure limits a current supplied to a plurality of pixels included in a display panel, which displays a video based on a video signal, to control a power consumption value in the plurality of pixels to be less than or equal to a control target power value, in which each of the plurality of pixels includes a self-light-emitting element, wherein the current limiting method includes: power calculation for calculating a screen power value related to the power consumption value based on pixel values of the video signal respectively corresponding to the plurality of pixels; gain determination for determining a gain based on the screen power value; and gain multiplication for multiplying the pixel values respectively corresponding to the plurality of pixels by the gain, where the screen power value provided when a current corresponding to an upper limit value of the pixel values respectively corresponding to the plurality of pixels is defined as a rated power value, a ratio of the screen power value with respect to the rated power value is defined as a screen power ratio, and a ratio of the control target power value with respect to the rated power value is defined as a target power ratio, the gain determined in the gain determination is 1 when the screen power ratio is less than or equal to a first power ratio less than the target power ratio, the gain monotonously decreases with respect to the screen power ratio when the screen power ratio is greater than the first power ratio and less than or equal to 100%, the gain is a value less than a value obtained by dividing the target power ratio by the screen power ratio when the screen power ratio is greater than or equal to the target power ratio and less than 100%, and the gain is the target power ratio when the screen power ratio is 100%.

Advantageous Effects

The present disclosure can provide a current limiting circuit, etc. which can improve the gamma characteristics. For example, the current limiting circuit, etc. can be provided which can provide the same gamma characteristics for single color displaying and white displaying even in large area video displaying. Moreover, a current limiting circuit, etc. can be provided which can bring gamma characteristics provided in large area video displaying closer to gamma characteristics provided in small area video displaying.

BRIEF DESCRIPTION OF DRAWINGS

These and other advantages and features will become apparent from the following description thereof taken in conjunction with the accompanying Drawings, by way of non-limiting examples of embodiments disclosed herein.

DESCRIPTION OF EMBODIMENTS

Figure 1:
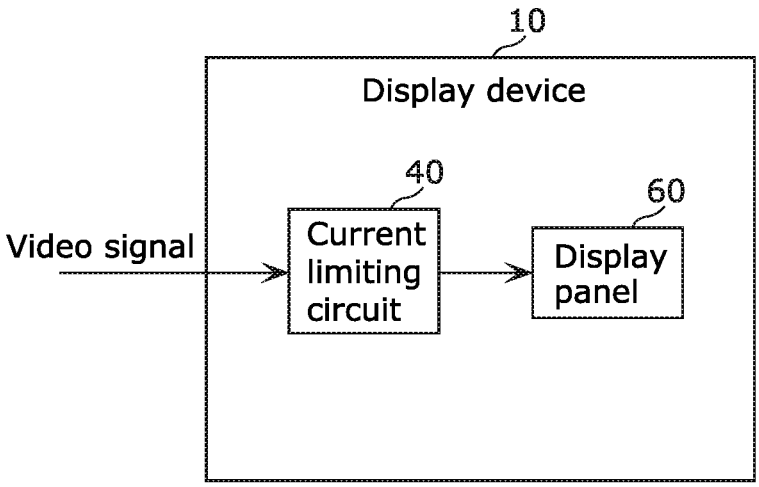
FIG. 1 is a block diagram illustrating a functional configuration of a display device according to Embodiment 1.

Hereinafter, the embodiments of the present disclosure will be described with reference to the drawings. Note that the embodiments described below each illustrate one detailed example of the present disclosure. Therefore, numerical values, shapes, materials, components, arrangement positions and connection forms of the components, and steps as well as procedures of the steps, etc. form one example, and are not intended to limit the present disclosure.

Note that each of the drawings does not necessarily provide a precise illustration. Moreover, substantially same configurations are provided with same signs in the drawings and overlapping description thereof will be omitted or simplified.

Embodiment 1

A current limiting circuit, etc. according to Embodiment 1 will be described.

[1-1. Overall Configuration of Display Device]

Figure 2:
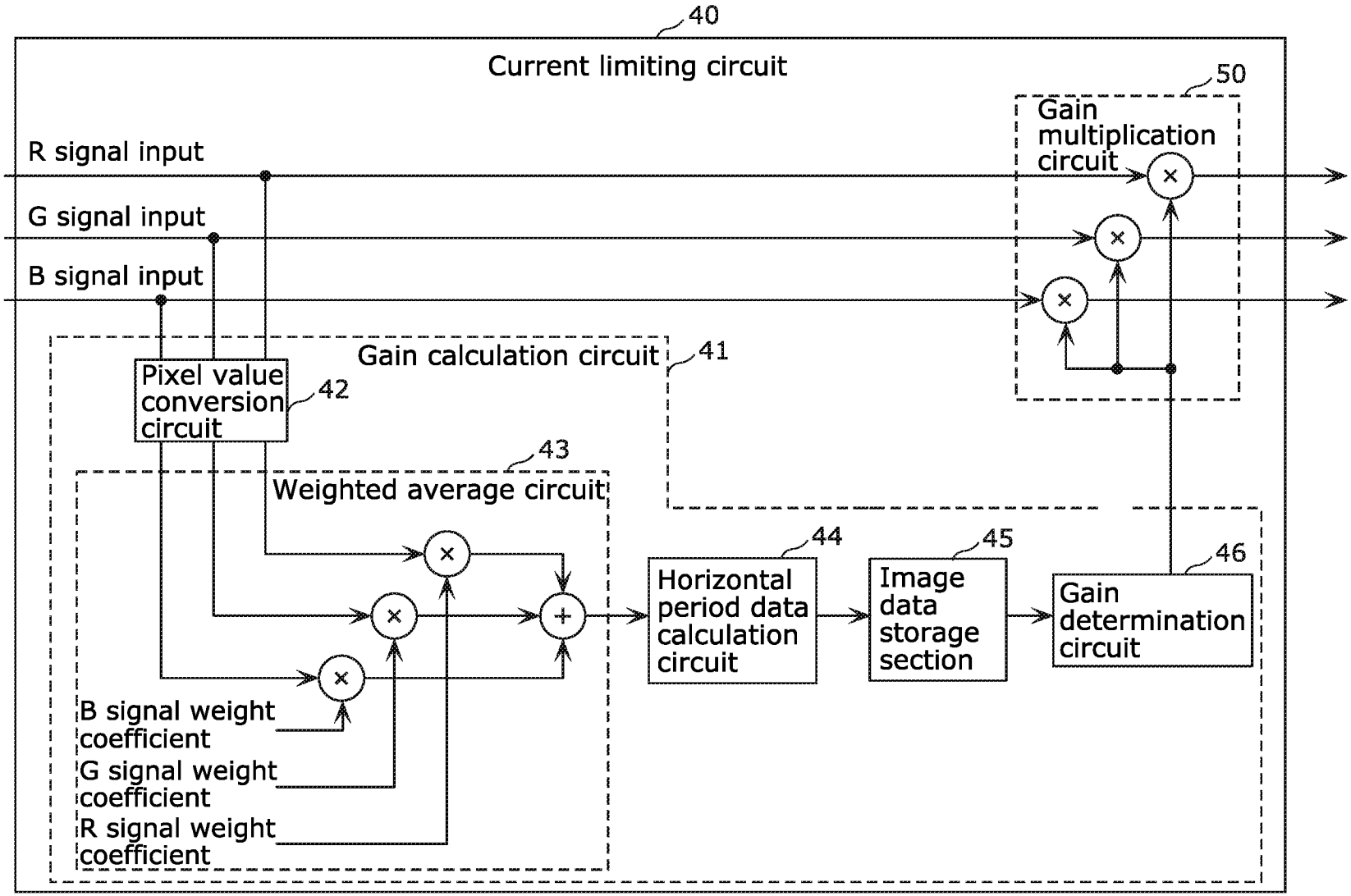
FIG. 2 is a block diagram illustrating a functional configuration of a current limiting circuit included in the display device according to Embodiment 1.
Figure 3:
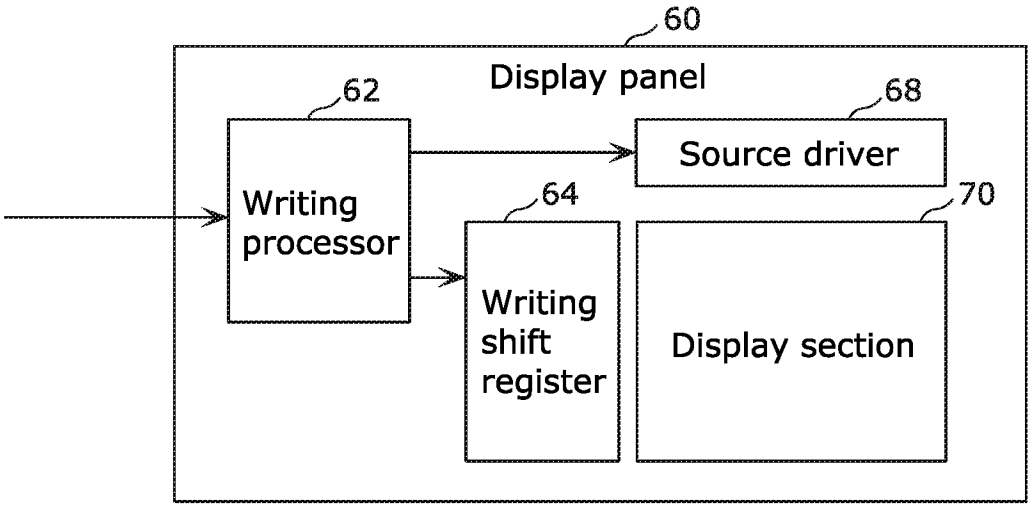
FIG. 3 is a block diagram illustrating a functional configuration of a display panel included in the display device according to Embodiment 1.

First, the overall configuration of the display device according to the present embodiment will be described with reference to FIGS. 1 to 3.

FIG. 1 is a block diagram illustrating a functional configuration of display device 10 according to the present embodiment. FIG. 2 is a block diagram illustrating a functional configuration of current limiting circuit 40 included in display device 10 according to the present embodiment. FIG. 3 is a block diagram illustrating a functional configuration of display panel 60 included in display device 10 according to the present embodiment.

Display device 10 illustrated in FIG. 1 is a device which displays a video based on a video signal and includes current limiting circuit 40 and display panel 60.

Display panel 60 is a panel which has a plurality of pixels and displays a video based on a video signal. Each of the plurality of pixels has a plurality of sub-pixels. Each of the plurality of sub-pixels includes a self-light-emitting element. In the present embodiment, each of the plurality of pixels has three sub-pixels respectively corresponding to three colors RGB. As illustrated in FIG. 3, display panel 60 has display section 70, write processor 62, source driver 68, and writing shift register 64. Display section 70 has the plurality of pixels and displays the video corresponding to the video signal. Write processor 62 outputs a control signal and a data signal for writing, into display section 70, a pixel value corresponding to display data. Note that the pixel value here is a signal level which specifies the tone (brightness) of each pixel and is also called a tone level or simply a signal level. Source driver 68 outputs the data signal to display section 70. Writing shift register 64 outputs, to display section 70, a write signal as the control signal for writing the data signal into display section 70.

Current limiting circuit 40 is a circuit which limits the current supplied to the plurality of pixels included in display panel 60 to thereby control a power consumption value in the plurality of pixels to be less than or equal to a control target power value. In the present embodiment, current limiting circuit 40 calculates a value of a power supplied to the plurality of pixels based on the video signal to thereby limit the current supplied to the plurality of pixels based on the power value. More specifically, current limiting circuit 40 corrects each pixel value in the video signal and outputs each corrected pixel value to display panel 60 to thereby limit the current supplied the plurality of pixels. In the present embodiment, current limiting circuit 40 multiplies each pixel value by a gain determined based on the video signal to thereby correct each pixel value. As illustrated in FIG. 2, current limiting circuit 40 has gain calculation circuit 41 and gain multiplication circuit 50.

Gain calculation circuit 41 is a circuit which calculates a screen power value related to the power consumption value in the plurality of pixels based on the pixel values of the video signal respectively corresponding to the plurality of sub-pixels respectively included in the plurality of pixels and calculates a gain based on the screen power value. When the screen power value exceeds the control target power value, gain calculation circuit 41 sets the gain to a ratio of the screen power value with respect to the control target power value, and when the screen power value is less than or equal to the control target power value, gain calculation circuit 41 sets the gain to 1. When a maximum value of the pixel values of the video signal respectively corresponding to the plurality of sub-pixels in the plurality of pixels exceeds a first threshold value, gain calculation circuit 41 uses, instead of the pixel values respectively corresponding to the plurality of sub-pixels, a common pixel value greater than or equal to the maximum value to calculate the screen power value.

Gain calculation circuit 41 has pixel value conversion circuit 42, weighted average circuit 43, horizontal period data calculation circuit 44, screen data storage section 45, and gain determination circuit 46.

Pixel value conversion circuit 42 is a circuit which receives the video signal and converts the pixel values respectively corresponding to the plurality of sub-pixels respectively included in the plurality of pixels. When the maximum value of the pixel values of the video signal respectively corresponding to the plurality of sub-pixels in the plurality of pixel exceeds the first threshold value, pixel value conversion circuit 42 changes the pixel values respectively corresponding to the plurality of sub-pixels to the common pixel value greater than or equal to the maximum value. In the present embodiment, the first threshold value is a lower limit value of the pixel values and the common pixel value is the maximum value of the pixel values respectively corresponding to the plurality of sub-pixels. For example, when a range of the pixel values respectively corresponding to the sub-pixels is equal to or greater than 0 and less than or equal to 255, the lower limit value of the pixel values is 0. That is, in the present embodiment, when the maximum value of the pixel values respectively corresponding to the plurality of sub-pixels in the plurality of pixels exceeds the first threshold value, pixel value conversion circuit 42 brings the pixel values respectively corresponding to the plurality of sub-pixels into agreement with the maximum value of the pixel values respectively corresponding to the plurality of sub-pixels. Details of operation performed by pixel value conversion circuit 42 will be described later on.

Weighted average circuit 43 is a circuit which calculates a weighted average of the pixel values respectively corresponding to the plurality of sub-pixels respectively included in the plurality of pixels. As illustrated in FIG. 2, weighted average circuit 43 multiplies the respective pixel values of the RGB by a weighted coefficient according to power consumption characteristics of the respective plurality of sub-pixels of display section 70 and calculates a sum of products obtained therefrom.

Horizontal period data calculation circuit 44 calculates horizontal period power conversion data corresponding to the pixel value for each horizontal period. In the present embodiment, horizontal period data calculation circuit 44 calculates, as the horizontal period power conversion data (level integrated value), an integrated value or an average value of the weighted average outputted by weighted average circuit 43 in the horizontal period.

Screen data storage section 45 stores one frame of the power conversion data. In the present embodiment, screen data storage section 45 stores one frame of the power conversion data outputted by horizontal period data calculation circuit 44.

Based on the power conversion data stored in screen data storage section 45 and the control target power value, gain determination circuit 46 determines the gain to be multiplied to the video signal. In the present embodiment, gain determination circuit 46 calculates a screen power value related to the one frame of the power consumption value in the plurality of pixels based on the power conversion data stored in screen data storage section 45. Further, when the screen power value exceeds the control target power value, gain determination circuit 46 calculates, as the gain, a ratio of the control target power value with respect to the screen power value. In this case, the gain is less than 1. When the screen power value does not exceed the control target power value, gain determination circuit 46 sets the gain to 1. The control target power value is appropriately set in accordance with the number of the plurality of pixels of display device 10. In the present embodiment, the control target power value is 40% of the screen power value required when a rated current is supplied to the self-light-emitting elements of all the sub-pixels.

Gain multiplication circuit 50 is a circuit which multiplies the video signal by the gain. Specifically, gain multiplication circuit 50 multiplies the pixel values of the video signal respectively corresponding to the plurality of sub-pixels by the gain determined by gain determination circuit 46. Consequently, when the screen power value exceeds the control target power value, the video signal is multiplied by the gain less than 1, which can therefore reduce the luminance of the video signal. Therefore, the current supplied to the plurality of pixels of display panel 60 is limited.

Figure 4:
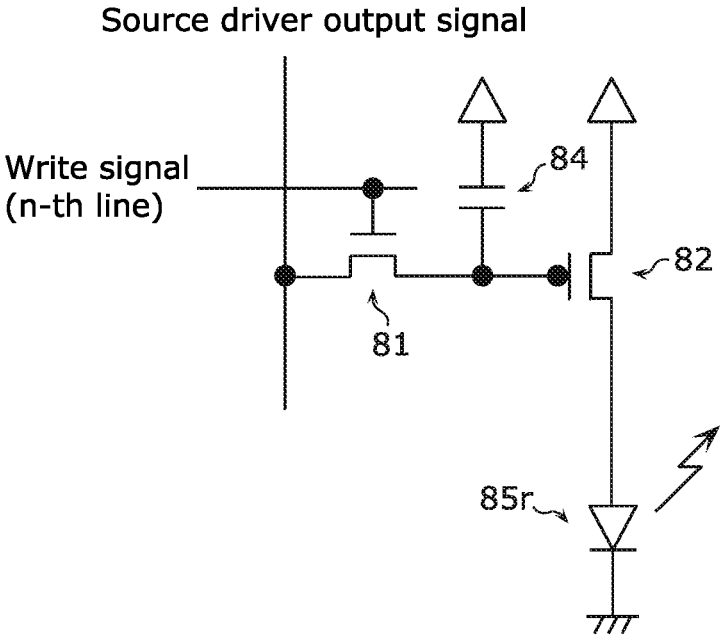
FIG. 4 is a circuit diagram illustrating one example of a configuration of a sub-pixel forming a pixel according to Embodiment 1.

The plurality of pixels included in display panel 60 will be described with reference to FIG. 4. FIG. 4 is a circuit diagram illustrating one example of a configuration of the sub-pixel forming the pixel according to the present embodiment. Illustrated in FIG. 4 is the sub-pixel using an organic EL element as the self-light-emitting element. The pixel according to the present embodiment includes the three sub-pixels respectively corresponding to the three colors RGB. The sub-pixel illustrated in FIG. 4 is provided for emitting red (R) light. Note that the sub-pixel for emitting green or blue light also has the same circuit configuration as that of the circuit illustrated in FIG. 4.

As illustrated in FIG. 4, the sub-pixel has thin film transistor (TFT) 81, capacitor 84, TFT 82, and self-light-emitting element 85*r*.

Inputted to one end of TFT 81 is a data signal as an output signal of source driver 68. Capacitor 84 is connected to TFT 81. TFT 82 has a control terminal connected to a point of connection between TFT 81 and capacitor 84. Self-light-emitting element 85*r* is connected to TFT 82.

TFT 81 switches between ON and OFF based on a given write signal as a control signal outputted by writing shift register 64. When TFT 81 has been turned ON by the write signal within one horizontal period, the data signal as a source driver output signal in accordance with a signal level written into the pixel is held by capacitor 84.

After the write signal has been turned OFF, a current in accordance with a voltage held by capacitor 84 flows to TFT 82 whereby self-light-emitting element 85*r* lights up.

[1-2. Operation of Current Limiting Circuit]

Next, the operation of current limiting circuit 40 will be described.

Figure 5:
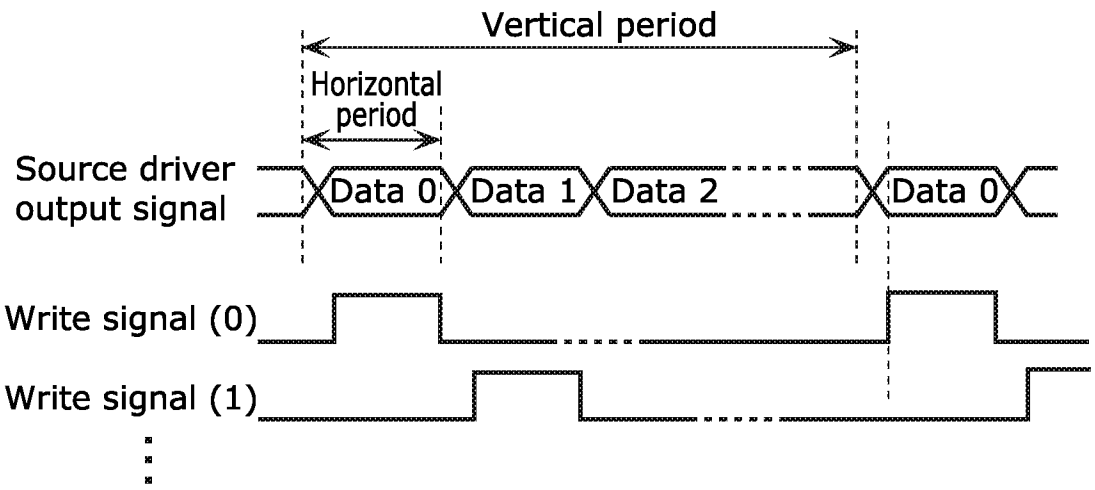
FIG. 5 is a diagram illustrating one example of a write signal inputted to the sub-pixel according to Embodiment 1.

First, the signal inputted to the sub-pixel illustrated in FIG. 4 will be described with reference to FIG. 5. FIG. 5 is a diagram illustrating one example of the write signal inputted to the sub-pixel according to the present embodiment. Display device 10 writes the data signal outputted by source driver 68 into display section 70 based on the write signal and performs emission in units of horizontal lines (hereinafter simply referred to as "line").

Figure 6:
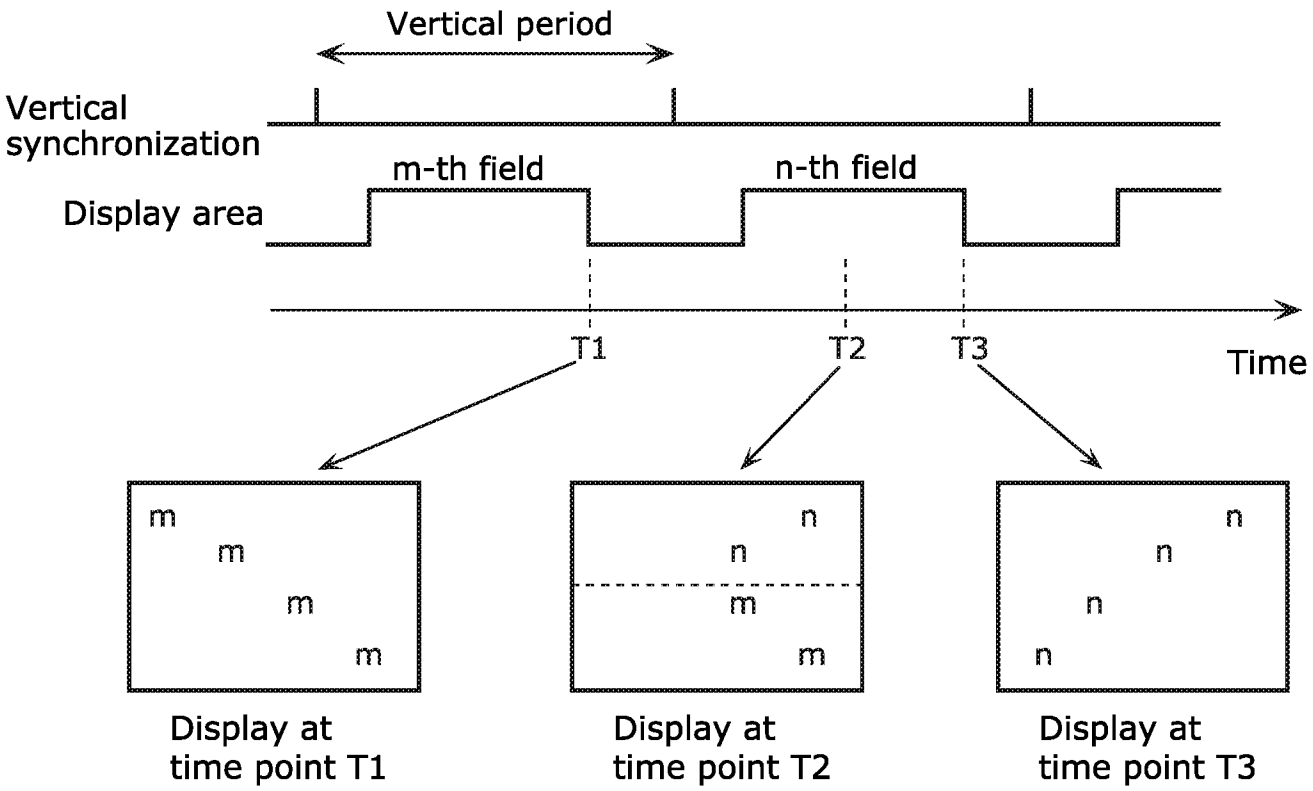
FIG. 6 is a schematic diagram illustrating transition of a display state of a display section according to Embodiment 1.

Next, the transition of a display state of display section 70 will be described with reference to FIG. 6. FIG. 6 is a schematic diagram illustrating the transition of the display state of display section 70 according to the present embodiment. In FIG. 6, a display screen transits from the display at time point T1 to time point T2 and from the display at time point T2 to time point T3. At time point T1 corresponding to an end of an m-tph field illustrated in FIG. 6, a screen of the m-tph field is displayed. Here, writing shift register 64 which outputs the write signal as the control signal for writing the data signal into each pixel outputs the write signal so as to scan the screen from the top to the bottom with the head of the display area of display section 70 defined as a start point. Thus, at time point T2 corresponding to the middle of an n-th field as a field (that is, an (m+1)-th field) next to the m-th field, an upper half of the screen serves as a screen of the n-th field and a lower half remains as the screen of the m-th field. At time point T3 corresponding to the end of the n-th field, scanning down to the bottom of the display area is performed and a full screen serves as a screen of the n-th field.

Next, operation of pixel value conversion circuit 42 will be described. As described above, pixel value conversion circuit 42 receives the video signal, and when the maximum value of the pixel values respectively corresponding to the plurality of sub-pixels in each of the plurality of pixels exceeds the first threshold value, pixel value conversion circuit 42 changes the pixel values respectively corresponding to the plurality of sub-pixels to the common pixel value greater than or equal to the maximum value. In the present embodiment, the first threshold value is the lower limit value of the pixel values and the common pixel value is the maximum value of the pixel values respectively corresponding to the plurality of sub-pixels. For example, where a range of the pixel value corresponding to each sub-pixel is greater than or equal to 0 and less than or equal to 255, the lower limit value of the pixel values is 0. That is, in the present embodiment, when the maximum value of the pixel values respectively corresponding to the plurality of sub-pixels in each of the plurality of pixels exceeds the first threshold value, pixel value conversion circuit 42 brings the pixel values respectively corresponding to the plurality of sub-pixels into agreement with the maximum value of the pixel values respectively corresponding to the plurality of sub-pixels. For example, when the pixel values respectively corresponding to the three sub-pixels corresponding to R, G, and B included in one pixel are 0, 10 and 5, respectively, pixel value conversion circuit 42 brings all the pixel values respectively corresponding to the three sub-pixels of the aforementioned pixel into agreement with 10. Such a common pixel value is determined for each of the plurality of pixels. That is, the common pixel value can vary from one pixel to another.

Figure 7:
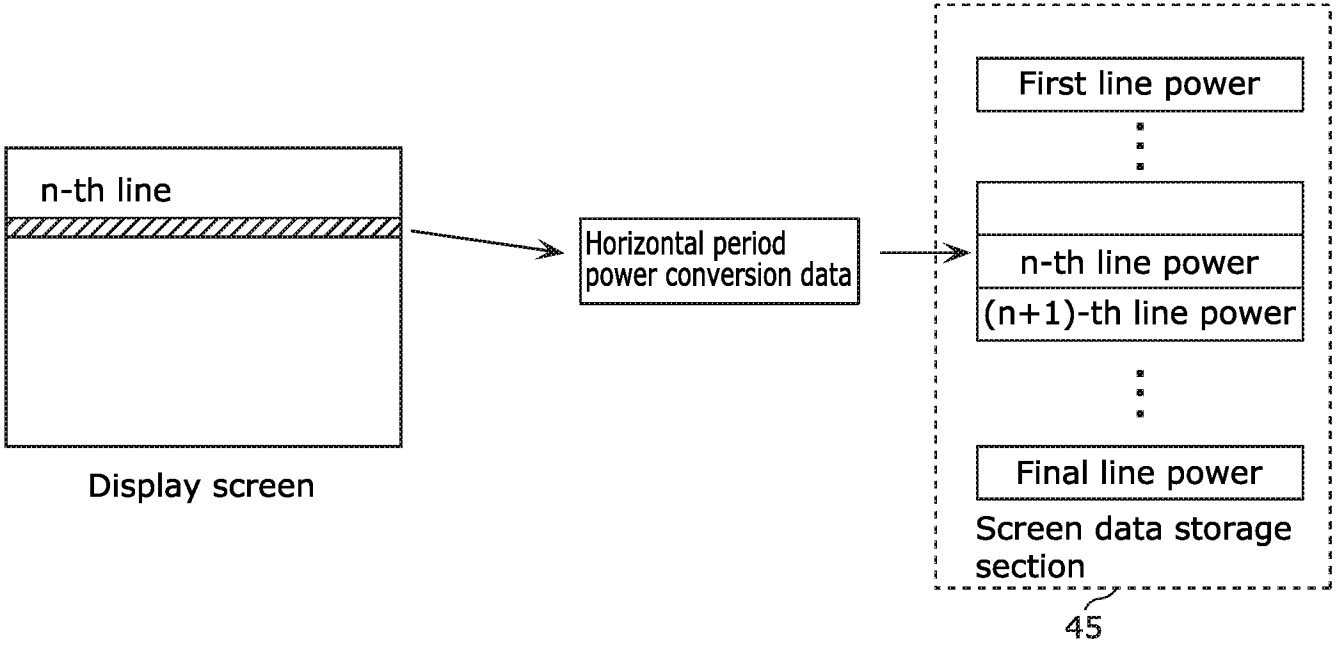
FIG. 7 is a schematic diagram illustrating a configuration of a screen data storage section according to Embodiment 1.

Next, a configuration of screen data storage section 45 will be described with reference to FIG. 7. FIG. 7 is a schematic diagram illustrating the configuration of screen data storage section 45 according to the present embodiment. As illustrated in FIG. 7, screen data storage section 45 stores, as signal information written into display section 70, the horizontal period power conversion data for each horizontal line on the display screen of display section 70. Note that the signal information stored herein is a pixel value converted by pixel value conversion circuit 42. For example, the horizontal period power conversion data for the i-th line is stored as a power value of the i-th line into screen data storage section 45. Upon start of rewriting of the next field, screen data storage section 45 also newly rewrites the power value to be stored and stores it as a power value corresponding to the signal written into the display screen.

Figure 8:
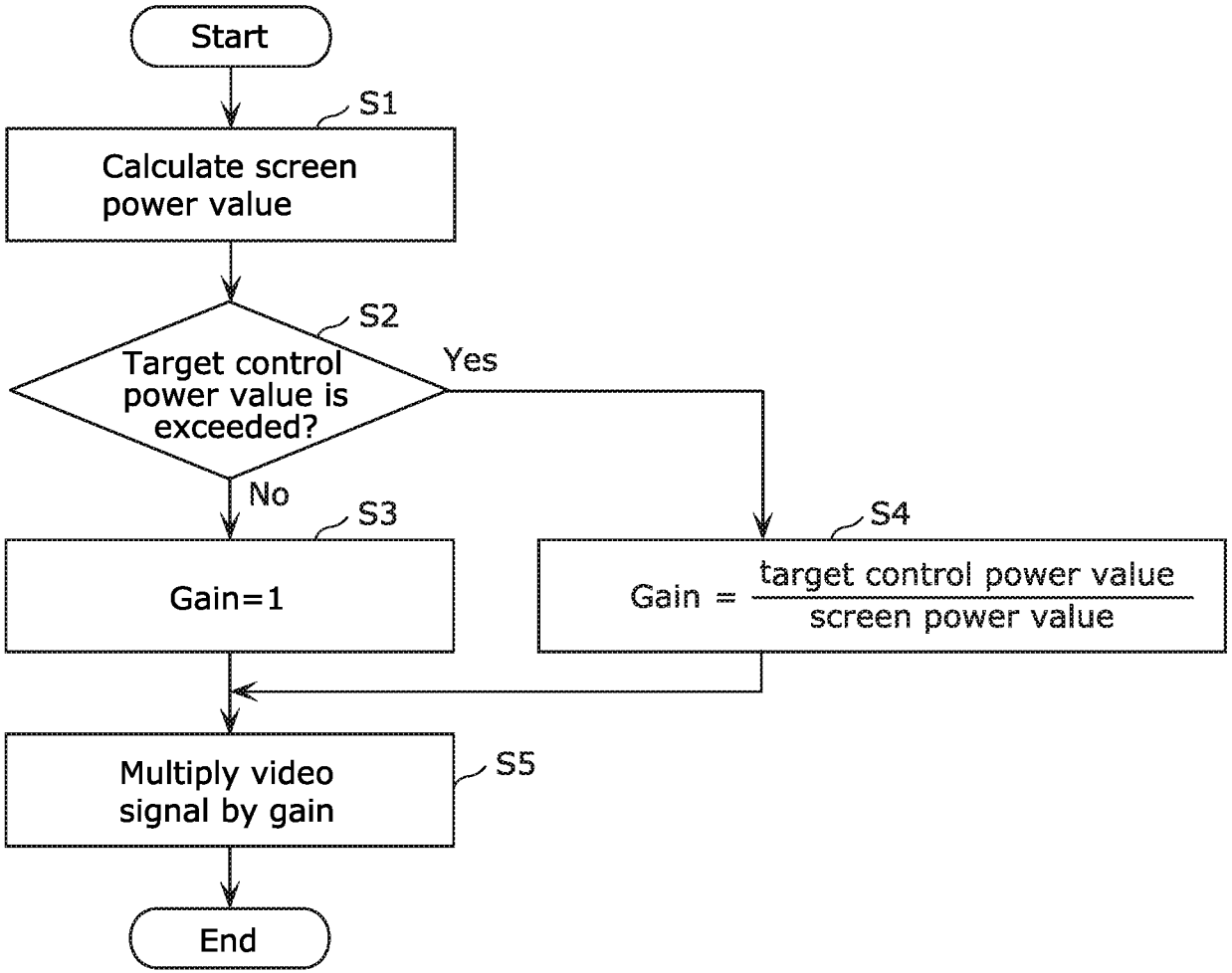
FIG. 8 is a flowchart illustrating a flow of a current limiting method according to Embodiment 1.

Next, calculation processing performed in gain determination circuit 46 and gain multiplication circuit 50 will be described with reference to FIG. 8. FIG. 8 is a flowchart illustrating a flow of a current limiting method according to the present embodiment.

As illustrated in FIG. 8, gain determination circuit 46 first calculates the screen power value based on the horizontal period power conversion data stored in screen data storage section 45 (S1). More specifically, a sum of pieces of the horizontal period power conversion data for the number of horizontal lines stored in screen data storage section 45 is calculated as the screen power value.

Subsequently, gain determination circuit 46 calculates the gain based on the screen power value calculated in step S1. More specifically, gain determination circuit 46 first judges whether or not the calculated screen power value exceeds a predefined control target power value (S2). When the screen power value is less than or equal to the control target power value (No in S2), gain determination circuit 46 sets the gain to 1 (S3). On the other hand, when the screen power value exceeds the control target power value (Yes in S2), gain determination circuit 46 sets the gain to a ratio of the control target power value with respect to the screen power value (S4).

The gain calculated by gain calculation circuit 41 as described above is inputted to gain multiplication circuit 50. Gain multiplication circuit 50 multiplies the video signal by the gain (S5) to thereby limit the current supplied to the plurality of pixels of display panel 60 when the screen power value exceeds the control target power value.

[1-3. Operation Example]

Figure 9:
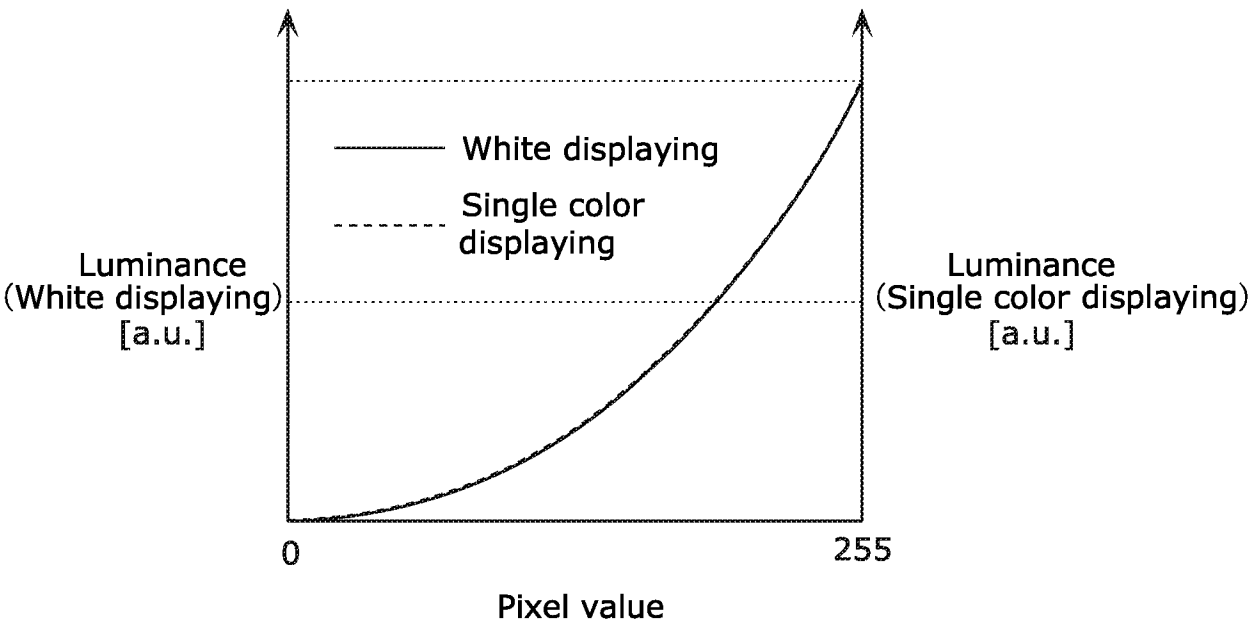
FIG. 9 is a schematic graph illustrating gamma characteristics provided in small area video displaying of the display device according to Embodiment 1 and a display device of a comparative example.
Figure 10:
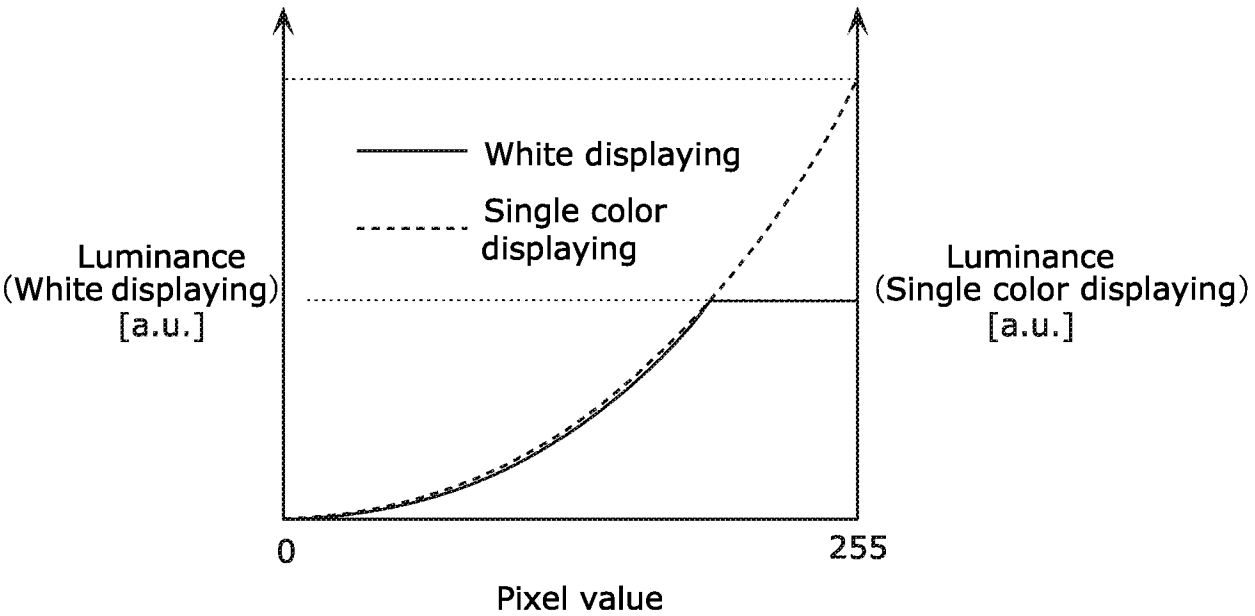
FIG. 10 is a schematic graph illustrating gamma characteristics provided in large area video displaying of the display device of the comparative example.
Figure 11:
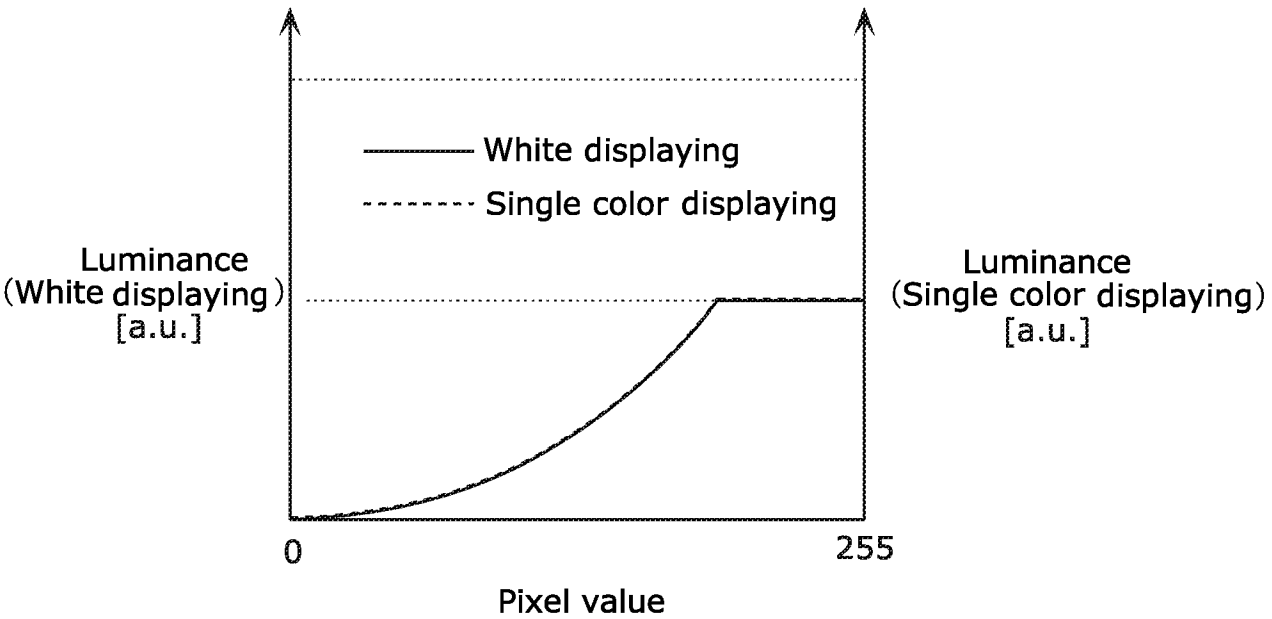
FIG. 11 is a schematic graph illustrating gamma characteristics provided in large area video displaying of the display device according to Embodiment 1.

Next, the operation example of display device 10 according to the present embodiment will be described with reference to FIGS. 9 to 11 in comparison to operation of a display device of a comparative example. FIG. 9 is a schematic graph illustrating gamma characteristics provided when display device 10 according to the present embodiment and the display device of the comparative example provide small area video displaying. Illustrated in FIG. 9 are the gamma characteristics provided when only 10% of the plurality of pixels does not provide black displaying and the remaining 90% of the pixels provides the black displaying. FIGS. 10 and 11 are schematic graphs respectively illustrating gamma characteristics provided when the display device of the comparative example and display device 10 according to the present embodiment provide large area video displaying. Illustrated in FIGS. 10 and 11 are the gamma characteristics provided when all the plurality of pixels does not provide black displaying. In FIGS. 9 to 11, the gamma characteristics provided in single color displaying where the current is supplied only to the self-light-emitting element of the sub-pixel of any one of the RGB are indicated by a broken line and the gamma characteristics provided in white displaying where the current is supplied to the self-light-emitting elements of all the sub-pixels of the RGB are indicated by a solid line. Moreover, in each graph of FIGS. 9 to 11, a horizontal axis represents the pixel value, a left vertical axis represents luminance provided in the white displaying, and a right vertical axis represents the luminance provided in the single color displaying. In each graph, for the purpose of easier comparison between the white displaying and the single color displaying, the luminance at the left vertical axis and the right vertical axis are standardized. That is, the luminance at the right vertical axis and the left vertical axis in each graph is in a desired unit, that is, the units are different from each other.

As is the case with display device 10 according to the present embodiment, the display device of the comparative example includes a current limiting circuit which limits a current supplied to a plurality of pixels. The current limiting circuit included in the display device of the comparative example includes: a gain calculation circuit which calculates a screen power value related to a power consumption value in the plurality of pixels based on the pixel values respectively corresponding to a plurality of sub-pixels and calculates a gain based on the screen power value; and a gain multiplication circuit which multiplies the pixel values respectively corresponding to the plurality of sub-pixels by the gain. The current limiting circuit included in the display device of the comparative example differs from display device 10 according to the present embodiment in that the pixel values respectively corresponding to the plurality of sub-pixels are not changed to a common pixel value greater than or equal to a maximum value in the calculation of the screen power value even when the maximum value of the pixel values respectively corresponding to the plurality of sub-pixels exceeds the first threshold value. The current limiting circuit included in the display device of the comparative example calculates the screen power value by directly using the pixel values respectively corresponding to the plurality of sub-pixels.

In the small area video displaying, as illustrated in FIG. 9, both display device 10 according to the present embodiment and the display device of the comparative example provide the same graph indicating a relation between the pixel value and the luminance for the single color displaying and the white displaying. Specifically, the same gamma characteristics are provided for the single color displaying and the white displaying. In the small area video displaying, the number of pixels to which the current is supplied is small, and thus the screen power value does not exceed the control target power value. Therefore, each sub-pixel emits light with luminance corresponding to the pixel value indicated by the video signal. In the present embodiment, the luminance of each sub-pixel is proportional to the power of 2.2 of the pixel value.

On the other hand, as illustrated in FIG. 10, the same curve indicating the relation between the pixel value and the luminance is not provided for the single color displaying (solid line in FIG. 10) and the white displaying (broken line in FIG. 10) in the large area video displaying in the display device of the comparative example. In the single color displaying, the screen power value does not exceed the control target power value in the large area video displaying, and each sub-pixel emits light with the luminance corresponding to the pixel value indicated by the video signal as is the case with the small area video displaying. However, the screen power value exceeds the control target power value when the pixel value has increased in the white displaying, and thus each sub-pixel emits light with the luminance corresponding to the pixel value obtained by multiplying the pixel value indicated by the video signal by the gain less than 1. Therefore, as illustrated by the solid line of FIG. 10, when the pixel value is large in the white displaying, a value of the luminance becomes constant (that is, the luminance does not change depending on the pixel value).

In display device 10 according to the present embodiment, as illustrated in FIG. 11, the same graph indicating the relation between the pixel value and the luminance is also provided in the large area video displaying as is the case with the small area video displaying. That is, the same gamma characteristics are provided for the single color displaying and the white displaying. Such gamma characteristics are provided for the following reasons. In gain calculation circuit 41 according to the present embodiment, for example, when pixel values of the pixels emitting light are same in full screen display for the single color displaying and the white displaying, screen power values calculated are same. Thus, the gain is same for the single color displaying and the white displaying. Therefore, as a result of the use of current limiting circuit 40 according to the present embodiment, the same gamma characteristics of display device 10 are provided for the single color displaying and the white displaying.

[1-4. Effects, Etc.]

As described above, current limiting circuit 40 according to the present embodiment includes gain calculation circuit 41 which calculates the screen power value related to the power consumption value in the plurality of pixels based on the pixel values of the video signal respectively corresponding to the plurality of sub-pixels and then calculates the gain based on the screen power value; and gain multiplication circuit 50 which multiplies the pixel values respectively corresponding to the plurality of sub-pixels by the gain. When the maximum value of the pixel values respectively corresponding to the plurality of sub-pixels in each of the plurality of pixels exceeds the first threshold value, gain calculation circuit 41 calculates the screen power value by using the common pixel value greater than or equal to the aforementioned maximum value instead of the pixel values respectively corresponding to the plurality of sub-pixels. When the screen power value exceeds the control target power value, gain calculation circuit 41 sets the gain to a ratio of the control target power value with respect to the screen power value, and when the screen power value is less than or equal to the control target power value, gain calculation circuit 41 sets the gain to 1.

In gain calculation circuit 41 of current limiting circuit 40 having the aforementioned configuration, for example, when the pixel values of the pixels emitting light are same values exceeding the first threshold value for the single color displaying and the white displaying in the full screen display, screen power values calculated are same. Thus, the same gain is provided for the single color displaying and the white displaying. Therefore, as a result of the use of current limiting circuit 40 according to the present embodiment, the same gamma characteristics of display device 10 are provided for the single color displaying and the white displaying.

Moreover, the first threshold value may be the lower limit value of the pixel values in current limiting circuit 40 according to the present embodiment.

As a result of setting the first threshold value to the lower limit value of the pixel values as described above, regardless of the pixel values respectively corresponding to the plurality of sub-pixels, gain calculation circuit 41 changes the pixel values respectively corresponding to the plurality of sub-pixels to the common pixel value to calculate the screen power value. Therefore, the same gamma characteristics are provided with the given pixel value for the single color displaying and the white displaying.

Moreover, display device 10 according to the present embodiment includes current limiting circuit 40 and display panel 60.

Since display device 10 according to the present embodiment includes current limiting circuit 40, the same gamma characteristics are provided for the single color displaying and the white displaying.

Moreover, a current limiting method according to the present embodiment includes: current calculation for calculating a screen power value related to a power consumption value in a plurality of pixels based on pixel values of a video signal respectively corresponding to a plurality of sub-pixels; gain calculation for calculating a gain based on the screen power value; and gain multiplication for multiplying the pixel values of the video signal respectively corresponding to the plurality of sub-pixels by the gain. In the power calculation, when the maximum value of the pixel values respectively corresponding to the plurality of sub-pixels in each of the plurality of pixels exceeds the first threshold value, the common pixel value greater than or equal to the aforementioned maximum value is used instead of the pixel values respectively corresponding to the plurality of sub-pixels to calculate the screen power value, and when the screen power value exceeds the control target power value in the gain calculation, the gain is set to the ratio of the control target power value with respect to the screen power value and when the screen power value is greater than or equal to the control target power value, the gain is set to 1.

The current limiting method having the aforementioned configuration provides the same effects as those provided by current limiting circuit 40 described above.

Embodiment 2

A current limiting circuit, etc. according to Embodiment 2 will be described. The current limiting circuit according to the present embodiment differs from current limiting circuit 40 according to Embodiment 1 in that predetermined gamma characteristics are provided regardless of a display area in a display device. Hereinafter, the current limiting circuit, etc. according to the present embodiment will be described focusing on a difference from current limiting circuit 40, etc. according to Embodiment 1.

[2-1. Current Limiting Circuit]

First, the current limiting circuit according to the present embodiment will be described. The current limiting circuit according to the present embodiment has a gain calculation circuit and a gain multiplication circuit as is the case with current limiting circuit 40 according to Embodiment 1. The gain calculation circuit of the present embodiment differs from gain calculation circuit 41 according to Embodiment 1 in that a common pixel value is defined as an upper limit value of a pixel value, and is identical to gain calculation circuit 41 in other points. Note that a first threshold value is also a lower limit value of the pixel value in the present embodiment.

When the pixel value corresponding to the sub-pixel exceeds the first threshold value, the gain calculation circuit of the current limiting circuit as described above calculates, for the pixel including the aforementioned sub-pixel, a screen power value under assumption that white displaying is provided with the upper limit value of the pixel value. In the present embodiment, since the first threshold value is the lower limit value of the pixel value, the gain calculation circuit according to the present embodiment calculates, for the pixels other than those which provide black displaying, the screen power value under assumption that the white displaying is provided with the upper limit value of the pixel value. In other words, the same value is provided as the gain when the numbers of pixels other than those which provide black displaying are the same in the gain calculation circuit according to the present embodiment.

[2-2. Operation Example]

Figure 12:
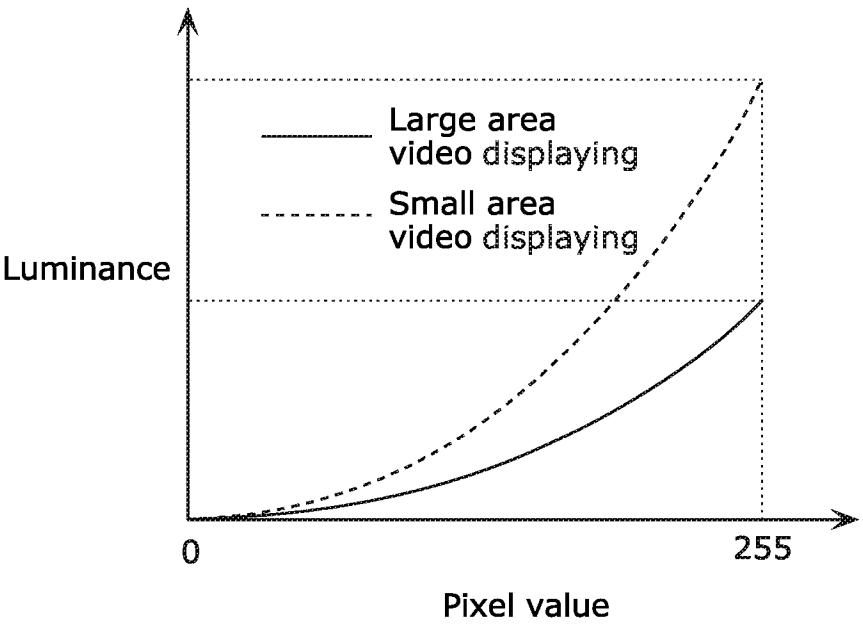
FIG. 12 is a schematic graph illustrating gamma characteristics provided in a display device including a current limiting circuit according to Embodiment 2.

Next, the operation example of the display device including the current limiting circuit according to the present embodiment will be described with reference to FIG. 12. FIG. 12 is a schematic graph illustrating gamma characteristics of the display device including the current limiting circuit according to the present embodiment. In FIG. 12, the gamma characteristics provided in small area video displaying are indicated by a broken line and the gamma characteristics provided in large area video displaying are indicated by a solid line. In the graph of FIG. 12, a horizontal axis represents a pixel value and a vertical axis indicates luminance. In FIG. 12, the gamma characteristics provided when light is emitted on 10% of all pixels (that is, black displaying is provided on 90% of all the pixels) are illustrated as the small area video displaying. Moreover, the gamma characteristics are provided as the large area video displaying when light is emitted on all the pixels (that is, no pixels provides black displaying) are illustrated.

As illustrated in FIG. 12, the luminance is proportional to the power of 2.2 of the pixel value in both the large area video displaying and the small area video displaying in the display device including the current limiting circuit according to the present embodiment. As described above, desired gamma characteristics can be provided in both the large area video displaying and the small area video displaying in the display device including the current limiting circuit according to the present embodiment.

[2-3. Effects, Etc.]

As described above, the common pixel value is the upper limit value of the pixel value in the current limiting circuit according to the present embodiment.

Consequently, desired gamma characteristics can be provided in both the large area video displaying and the small area video displaying in the display device including the current limiting circuit according to the present embodiment. For example, gamma characteristics such that the luminance is proportional to the power of 2.2 of the pixel value can be provided in the display device including the current limiting circuit according to the present embodiment.

Embodiment 3

A current limiting circuit, etc. according to Embodiment 3 will be described. The current limiting circuit according to the present embodiment differs from the current limiting circuit according to Embodiment 2 in that the first threshold value is not the lower limit value of the pixel value, and is identical to the current limiting circuit according to Embodiment 2 in other points. Hereinafter, the current limiting circuit, etc. according to the present embodiment will be described focusing on a difference from the current limiting circuit, etc. according to Embodiment 2.

The current limiting circuit according to the present embodiment has a gain calculation circuit and a gain multiplication circuit as is the case with the current limiting circuit according to Embodiment 2. The first threshold value is greater than the lower limit value of the pixel value and less than the upper limit value of the pixel value in the gain calculation circuit of the present embodiment. For example, a value approximately greater than 0% of the upper limit value of the pixel value and less than or equal to 5% thereof may be used as the first threshold value.

Noise may be superposed on the pixel value of the video signal corresponding to the sub-pixel included in the display panel in some cases. Thus, for example, even when the pixel value is the lower limit value in the video signal, noise may be superposed on the video signal and the aforementioned pixel value may change to a value slightly greater than the lower limit value in some cases.

With the current limiting circuit according to the present embodiment, such a pixel value slightly greater than the lower limit value is not assumed as the upper limit value upon the calculation of the screen power value by the gain calculation circuit, which therefore can reduce the sub-pixels whose pixel value is assumed as the screen power value. Accordingly, the screen power value calculated by the gain calculation circuit is reduced. Therefore, it is possible to prevent the gain calculated by the gain calculation circuit from becoming too small. That is, it is possible to brighten a video displayed on the display panel.

Embodiment 4

A current limiting circuit, etc. according to Embodiment 4 will be described.

[4-1. Overall Configuration of Display Device]

First, the overall configuration of the display device according to the present embodiment will be described with reference to FIGS. 13 and 14.

Figure 13:
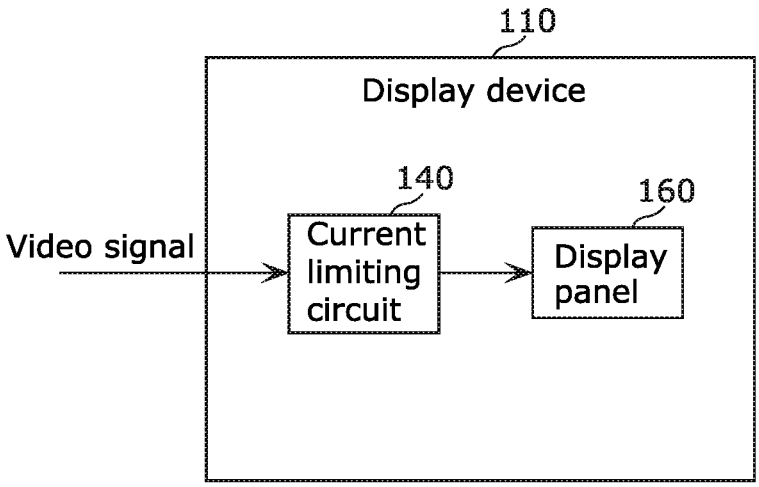
FIG. 13 is a block diagram illustrating a functional configuration of a display device according to Embodiment 4.
Figure 14:
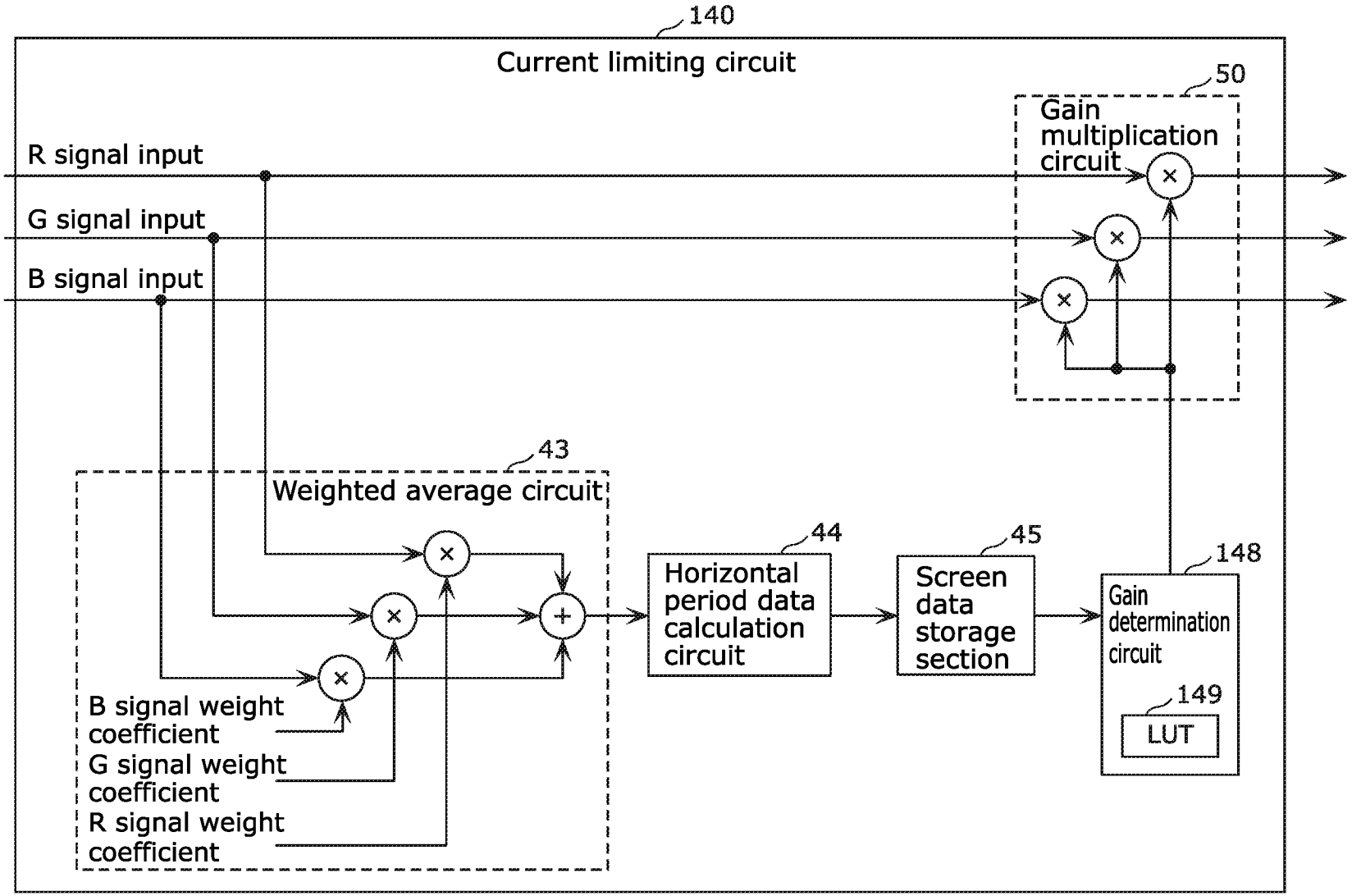
FIG. 14 is a block diagram illustrating a functional configuration of a current limiting circuit included in the display device according to Embodiment 4.

FIG. 13 is a block diagram illustrating a functional configuration of display device 110 according to the present embodiment. FIG. 14 is a block diagram illustrating a functional configuration of current limiting circuit 140 included in display device 110 according to the present embodiment.

Display device 110 illustrated in FIG. 13 is a device which displays a video based on a video signal and includes current limiting circuit 140 and display panel 160.

Display panel 160 is a panel which has a plurality of pixels and which displays a video based on a video signal. Each of the plurality of pixels includes self-light-emitting elements. In the present embodiment, each of the plurality of pixels has a plurality of sub-pixels, each of which includes the self-light-emitting element. In the present embodiment, each of the plurality of pixels has the three sub-pixels respectively corresponding to three colors RGB. In display panel 160 in the present embodiment, the luminance of each sub-pixel is proportional to a pixel value inputted to each sub-pixel. Note that the pixel value here is a signal level which defines the tone (brightness) of each pixel and is also called a tone level or simply a signal level.

Display panel 160 is not specifically limited as long as display panel 160 is a display panel whose luminance is proportional to the pixel value. For example, a plasma display panel may be used as display panel 160.

Current limiting circuit 140 is a circuit which limits a current supplied to the plurality of pixels included in display panel 160 to thereby control a power consumption value in the plurality of pixels to be less than or equal to a control target power value. In the present embodiment, current limiting circuit 140 calculates a value of a power supplied to the plurality of pixels based on the video signal and limits the current supplied to the plurality of pixels based on the aforementioned power value. More specifically, current limiting circuit 140 corrects each pixel value in the video signal and outputs each of the corrected pixel values to display panel 160 to thereby limit the current supplied to the plurality of pixels. In the present embodiment, current limiting circuit 140 multiplies each pixel value by a gain determined based on the video signal to thereby correct each pixel value. As illustrated in FIG. 14, current limiting circuit 140 has weighted average circuit 43, horizontal period data calculation circuit 44, screen data storage section 45, gain determination circuit 148, and gain multiplication circuit 50.

Weighted average circuit 43 is a circuit which calculates a weighted average of the pixel values respectively corresponding to the plurality of sub-pixels included in each of the plurality of pixels. As illustrated in FIG. 14, weighted average circuit 43 multiplies the respective pixel values of the RGB by a weighted coefficient in accordance with power consumption characteristics of each of the plurality of sub-pixels of display section 70 and calculates a sum thereof.

Horizontal period data calculation circuit 44 calculates horizontal period power conversion data corresponding to the pixel value for each horizontal period. In the present embodiment, horizontal period data calculation circuit 44 calculates, as the horizontal period power conversion data (level integrated value), an integrated value or an average value of the weighted averages outputted by weighted average circuit 43 in the horizontal period.

Screen data storage section 45 stores one frame of power conversion data. In the present embodiment, screen data storage section 45 stores one frame of the power conversion data outputted by horizontal period data calculation circuit 44.

Gain determination circuit 148 is a circuit which calculates a screen power value related to a power consumption value in the plurality of pixels based on the pixel values of the video signal respectively corresponding to the plurality of pixels and which determines a gain based on the screen power value. The gain is a value greater than 0 multiplied to each pixel value by gain multiplication circuit 50 and less than or equal to 1. The gain is determined to be a value less than 1 at least when the screen power value exceeds the control target power value. Multiplying each pixel value by such a gain limits the power consumption in display panel 160.

Gain determination circuit 148 calculates the screen power value according to one frame of the power consumption value in the plurality of pixels based on the power conversion data stored in screen data storage section 45. In the present embodiment, gain determination circuit 148 has lookup table (LUT) 149 indicating a relation between the value corresponding to the calculated screen power value and the value corresponding to the gain. Gain determination circuit 148 determines the gain corresponding to the calculated screen power value based on lookup table 149. Details of the gain determined by gain determination circuit 148 will be described later on.

Gain multiplication circuit 50 is a circuit which multiplies the video signal by the gain. Specifically, gain multiplication circuit 50 multiplies the pixel values of the video signal respectively corresponding to the plurality of sub-pixels by the gain determined by gain determination circuit 148. Consequently, the gain less than 1 is multiplied to the video signal when the screen power value exceeds the control target power value, which can therefore reduce the luminance of the video signal. Therefore, the current supplied to the plurality of pixels of display panel 160 is limited.

[4-2. Operation of Current Limiting Circuit]

Next, the operation of current limiting circuit 140 will be described.

Figure 15:
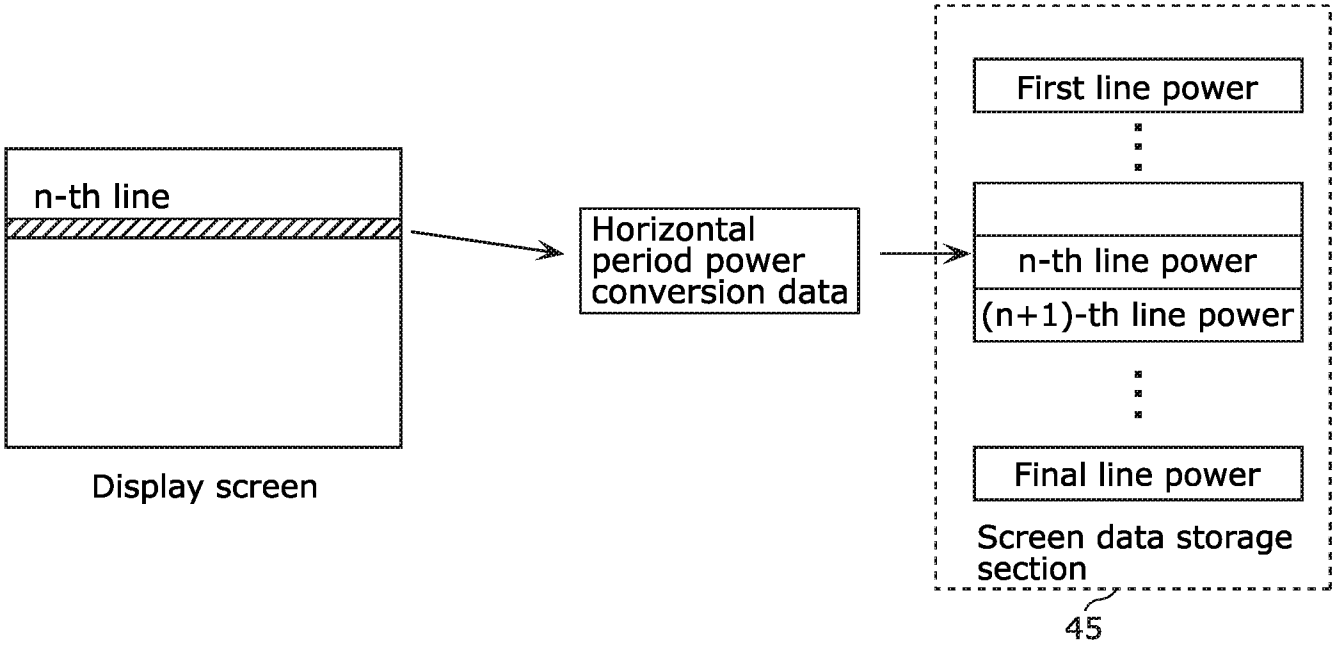
FIG. 15 is a schematic diagram illustrating a configuration of a screen data storage section according to Embodiment 4.

First, a configuration and operation of screen data storage section 45 included in current limiting circuit 140 will be described with reference to FIG. 15. FIG. 15 is a schematic view illustrating the configuration of screen data storage section 45 according to the present embodiment. As illustrated in FIG. 15, screen data storage section 45 stores, as signal information written into display section 70, horizontal period power conversion data for each horizontal line on the display screen of display section 70. For example, the horizontal period power conversion data of the i-th line is stored as the power value of the i-th line into screen data storage section 45. Upon start of rewriting of the next field, screen data storage section 45 also newly rewrites the power value to be stored and stores the aforementioned value as a power value corresponding to the signal written on the display screen.

Figure 16:
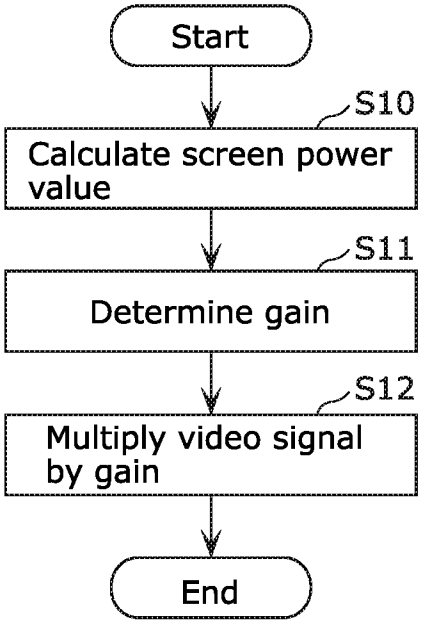
FIG. 16 is a flowchart illustrating a flow of calculation processing performed in a gain determination circuit and a gain multiplication circuit according to Embodiment 4.

Next, calculation processing performed in gain determination circuit 148 and gain multiplication circuit 50 will be described with reference to FIG. 16. FIG. 16 is a flowchart illustrating a flow of the calculation processing performed in gain determination circuit 148 and gain multiplication circuit 50 according to the present embodiment.

As illustrated in FIG. 16, gain determination circuit 148 first calculates the screen power value related to the power consumption value based on the pixel values of the video signal respectively corresponding to the plurality of pixels (S10). In the present embodiment, gain determination circuit 148 calculates the screen power value based on the horizontal period power conversion data stored in screen data storage section 45. More specifically, a sum of pieces of the horizontal period power conversion data for the number of horizontal lines stored in screen data storage section 45 is calculated as the screen power value.

Subsequently, gain determination circuit 148 determines the gain based on the screen power value calculated in step S10 (S11). More specifically, gain determination circuit 148 determines the gain corresponding to the calculated screen power value based on lookup table 149 indicating the relation between the value corresponding to the calculated screen power value and the value corresponding to the gain.

The gain calculated by gain determination circuit 148 as described above is inputted to gain multiplication circuit 50, which multiplies the video signal by the gain (S12). More specifically, gain multiplication circuit 50 multiplies each pixel value of the video signal by the gain. Consequently, when at least the screen power value exceeds the control target power value, each pixel value is reduced, which therefore limits the current supplied to the plurality of pixels of display panel 160.

[4-3. Operation Example]

Figure 17:
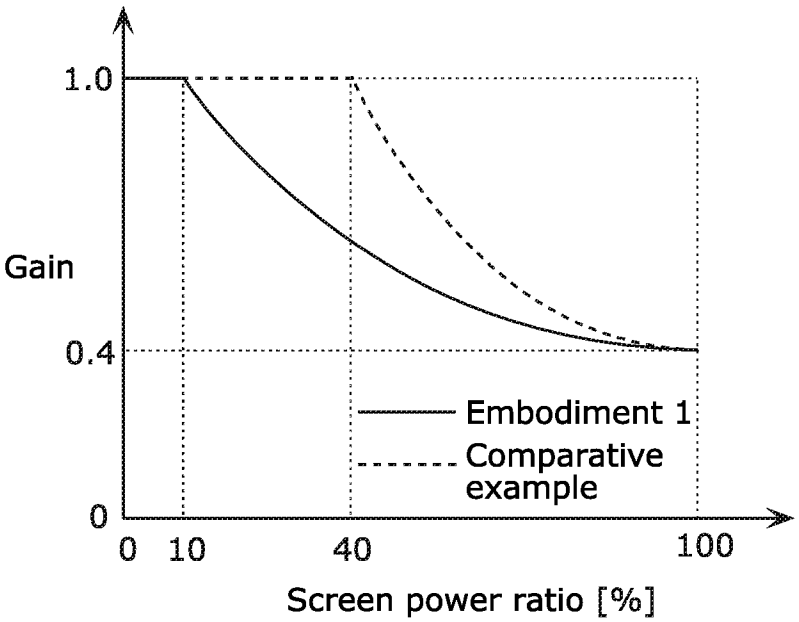
FIG. 17 is a graph illustrating a relation between a screen power ratio and a gain according to Embodiment 4.

Next, the operation example of display device 110 according to the present embodiment will be described with reference to FIG. 17 in comparison to operation of the display device of the comparative example. FIG. 17 is a graph indicating a relation between a screen power ratio and the gain according to the present embodiment. In FIG. 17, a horizontal axis represents the screen power ratio and a vertical axis represents the gain. Moreover, a relation between the screen power ratio and the gain in the current limiting circuit of the comparative example is also illustrated in FIG. 17. A solid line and a broken line illustrated in the graph of FIG. 17 respectively represent the gains of the present embodiment and the comparative example.

Assumed here is that the screen power value provided when the current corresponding to the upper limit value of the pixel values respectively corresponding to the plurality of pixels of display panel 160 is defined as a rated power value and a ratio of the screen power value corresponding to the rated power value is defined as a screen power ratio. The screen power value provided when the pixel values of all the pixels included in display panel 160 are upper limit values and the current is not limited is a rated power value. Moreover, the ratio of the control target power value with respect to the rated power value is defined as a target power ratio. The graph illustrated in FIG. 17 illustrates one example of a graph provided when the target power ratio is 0.4.

Figure 18:
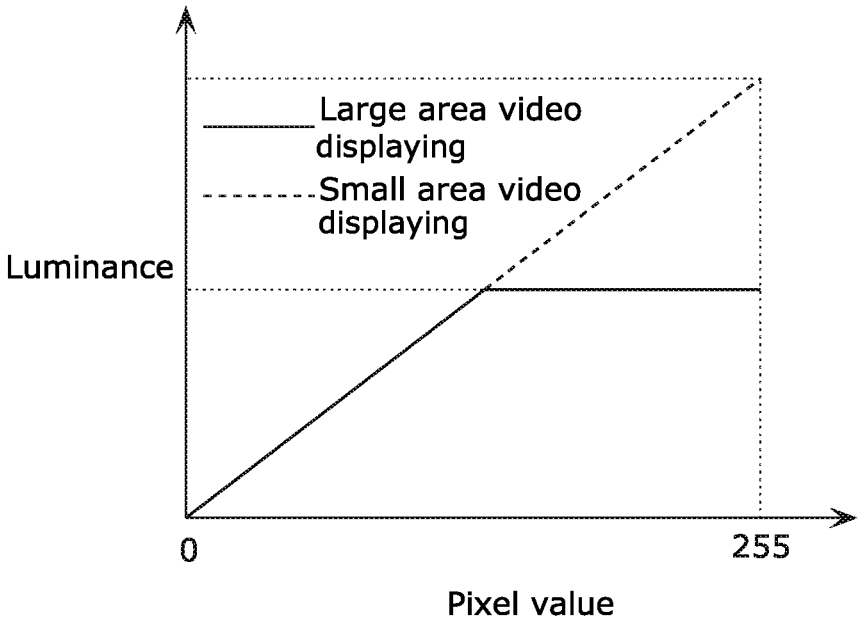
FIG. 18 is a graph illustrating gamma characteristics provided when a current limiting circuit of the comparative example is used.
Figure 19:
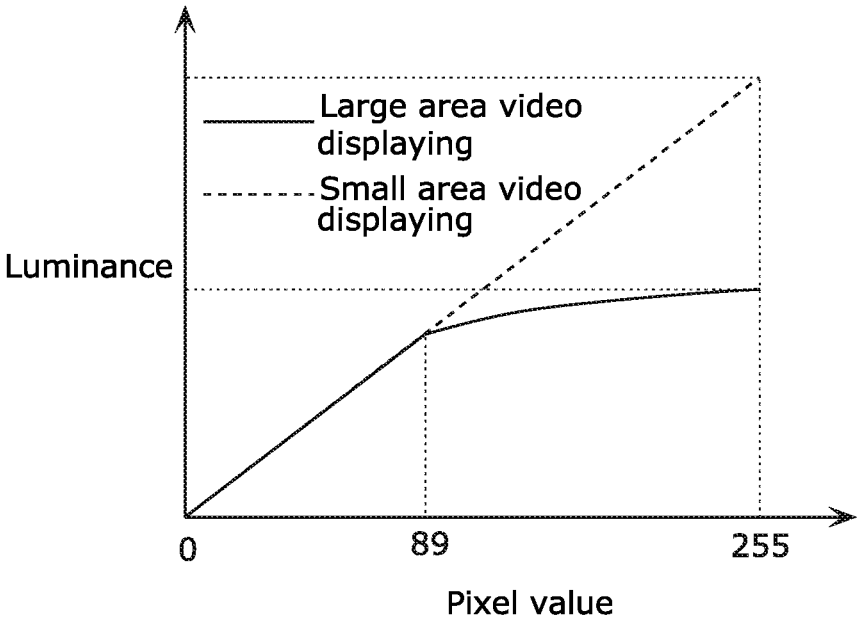
FIG. 19 is a graph illustrating gamma characteristics provided when the current limiting circuit according to Embodiment 4 is used.

In the current limiting circuit of the comparative example using the gain indicated by the broken line of FIG. 17, the gain is 1 when the screen power ratio is less than or equal to the target power ratio (40%) and the gain is reversely proportional to the screen power ratio when the screen power ratio is greater than 40%. The gamma characteristics provided when the current limiting circuit of the comparative example and current limiting circuit 140 according to the present embodiment described above are used in the display device will be described with reference to FIGS. 18 and 19. FIGS. 18 and 19 are graphs respectively illustrating the gamma characteristics provided when the current limiting circuit of the comparative example and current limiting circuit 140 according to the present embodiment are used. A solid line and a broken line illustrated in each of FIGS. 18 and 19 respectively illustrate the gamma characteristics for the large area video displaying and the small area video displaying. FIGS. 18 and 19 illustrate, as one example of the large area video displaying, the gamma characteristics provided when white displaying is provided on all the pixels and illustrate, as one example of the small area video displaying, the gamma characteristics provided when the white displaying is provided on 10% of the pixels and black displaying is provided on the remaining 90% of the pixels. A horizontal axis represents a pixel value and a vertical axis represents the luminance of each pixel in the graphs of FIGS. 18 and 19.

As illustrated in FIG. 18, the gain is 1 in the small area video displaying in the current limiting circuit of the comparative example and thus the gamma characteristics such that the luminance is proportional to the pixel value is provided. On the other hand, while the gamma characteristics such that the luminance is proportional to the pixel value is provided in a range where the pixel value is small, the luminance is constant in a range where the pixel value is close to the upper limit value (255) in the large area video displaying. As described above, the gamma characteristics largely differ from the gamma characteristics provided in the large area video displaying such that the luminance is proportional to the pixel value.

In current limiting circuit 140 according to the present embodiment, the gain determined by gain determination circuit 148 is 1 when the screen power ratio is less than or equal to 10%, and the gain monotonously decreases with respect to the screen power ratio when the screen power ratio is greater than 10% and less than or equal to 100%. Moreover, the gain is a value less than a value obtained by dividing the target power ratio by the screen power ratio when the screen power ratio is greater than or equal to the target power ratio and less than 100%, and the gain is the target power ratio when the screen power ratio is 100%. In other words, the gain according to the present embodiment is less than or equal to the gain of the comparative example when the screen power ratio is greater than 10% and less than the target power ratio, and the gain is smaller than the gain of the comparative example when the screen power ratio is greater than or equal to the target power ratio and less than 100%. The gain is equal to the gain of the comparative example when the screen power ratio is less than or equal to 10% and 100%.

In the present embodiment, the gain can be set in a desired manner by use of lookup table 149, which can therefore set an optimum gain with respect to the screen power value.

The description here that the gain monotonously decreases includes not only a case where the gain constantly decreases with respect to an increase in the screen power ratio but may also include a range where the gain is constant with respect to the increase in the screen power ratio. For example, a case where the gain decreases in a stepped manner with respect to the increase in the screen power ratio is also included in the case where the gain monotonously decreases.

In the example illustrated in FIG. 17, the gain is 1 in a range where the screen power ratio is less than or equal to 10% while the gain with respect to the screen power ratio monotonously decreases in a range where the screen power ratio is greater than 10% and less than or equal to 100%. In the example illustrated in FIG. 17, the graph of the gain provides a downwardly convex curve in the range where the screen power ratio is greater than 10% and less than or equal to 100% (that is, a rate of a change in the inclination of the graph is positive). More specifically, the gain G is expressed by Expression 1 below by using a screen power ratio P in at least part of a range where the screen power ratio is greater than a predefined value.

$$G=a\times P^{b-1}(0<a<1,\ b<1) \quad \text{(Expression 1).}$$

In the present embodiment, the gain G in the range where the screen power ratio P is greater than 10% and less than or equal to 100% is expressed by Expression 2 below.

$$G=0.4P^{(1.325/2.2-1)} \quad \text{(Expression 2).}$$

The gamma characteristics provided when current limiting circuit 140 according to the present embodiment is used will be described with reference to FIG. 19.

As illustrated in FIG. 19, since the gain is 1 in the small area video displaying, the gamma characteristics such that the luminance is proportional to the pixel value are provided. Moreover, gamma characteristics such that the luminance is proportional to the pixel value are provided in a range where the pixel value is small (a range of 89 or less) in the large area video displaying, and even in the range where the pixel value is close to the upper limit value (255) (a range greater than 89 and less than or equal to 255), the inclination of the graph indicating the luminance with respect to the respective pixel values of the plurality of pixels is greater than zero with the given pixel value. More specifically, with current limiting circuit 140 according to the present embodiment, gamma characteristics indicated by a curve close to a curve proportional to the pixel value are provided even in the range where the pixel value is close to the upper limit value. That is, the use of a value Y obtained by normalizing the luminance by the maximum value and a value X obtained by normalizing the pixel value by the maximum value establishes Expression 3 below in a range where the pixel value is less than or equal to 89.

$$Y=a1\times X^{b1} \quad \text{(Expression 3).}$$

Moreover, Expression 4 below is established in a range where the pixel value is greater than 89.

$$Y=a2\times X^{b2} \quad \text{(Expression 4).}$$

Here, a1=1>a2=0.4>0 and b1=1>b2>0 in the present embodiment.

As described above, with current limiting circuit 140 according to the present embodiment, it is possible to bring the gamma characteristics provided in the large area video displaying close to the gamma characteristics provided in the small area video displaying.

Moreover, with current limiting circuit 140 according to the present embodiment, the gain is less than 1 when the screen power ratio is greater than 10%. Consequently, it is possible to gently increase the gain by the current limiting circuit of the comparative example in a range where the screen power ratio is greater than 10%. Thus, it is possible to bring the gamma characteristics provided in the large area video displaying even closer to the gamma characteristics provided in the small area video displaying.

Note that the example where the target power ratio is 40% is illustrated in the description of current limiting circuit 140 according to the present embodiment, but the target power ratio is not limited to 40% as long as the target power ratio is greater than 0% and less than 100%.

Moreover, with current limiting circuit 140 according to the present embodiment, the gain is 1 when the screen power ratio is less than or equal to 10%, but the numerical value 10% is merely one example of a first power ratio as a value less than the target power ratio. In other words, the first power ratio is not limited to 10% as long as the first power ratio is greater than 0% and less than the target power ratio. The gain determined by gain determination circuit 148 of current limiting circuit 140 according to the present embodiment is 1 when the screen power ratio is less than or equal to the first power ratio which is less than the target power ratio. The aforementioned gain monotonously decreases with respect the screen power ratio when the screen power ratio is greater than the first power ratio and less than or equal to 100%. The aforementioned gain is a value less than a value obtained by dividing the target power ratio by the screen power ratio when the screen power ratio is greater than or equal to the target power ratio and less than 100%. The aforementioned gain is the target power ratio when the screen power ratio is 100%.

[4-4. Effects and Others]

As described above, current limiting circuit 140 according to the present embodiment includes: gain determination circuit 148 which calculates the screen power value related to the power consumption value based on the pixel values of the video signal respectively corresponding to the plurality of pixels and which determines the gain based on the screen power value; and gain multiplication circuit 50 which multiplies the pixel values respectively corresponding to the plurality of pixels by the gain. The gain determined by gain determination circuit 148 is 1 when the screen power ratio is less than or equal to the first power ratio which is less than the target power ratio, and the aforementioned gain monotonously decreases with respect to the screen power ratio when the screen power ratio is greater than the first power ratio and less than or equal to 100%. The aforementioned gain is a value less than a value obtained by dividing the target power ratio by the screen power ratio when the screen power ratio is greater than or equal to the target power ratio and less than 100%, and the aforementioned gain is the target power ratio when the screen power ratio is 100%.

With current limiting circuit 140 having a configuration as described above, it is possible to monotonously increase the luminance in all ranges of the pixel values even in the large area video displaying, which can therefore bring the gamma characteristics provided in the large area video displaying closer to the gamma characteristics provided in the small area video displaying.

Moreover, in current limiting circuit 140 according to the present embodiment, in a range where the pixel value is less than or equal to a predefined first value, the following relation is established between the value X obtained by normalizing the pixel value by the maximum value and the value Y obtained by normalizing the luminance of each of the plurality of pixels corresponding to the pixel values by the maximum value:

$$Y=a1\times X^{b1}(a1>0,\ b1>0) \quad \text{(Expression 5)},$$

in a range where the pixel value is greater than a predetermined value, the following expression is established:

$$Y=a2\times X^{b2} \quad \text{(Expression 6), and}$$

a1>a2>0 and b1>b2>0 may be further established.

Moreover, in current limiting circuit 140 according to the present embodiment, the following expression may be established between a gain G and the screen power ratio P in at least part of a range where a screen power ratio is greater than a predefined second value:

$$G=a\times P^{b-1}(0<a<1,\ b<1) \quad \text{(Expression 7)}.$$

Moreover, in current limiting circuit 140 according to the present embodiment, gain determination circuit 148 may have lookup table 149 indicating the relation between the value corresponding to the screen power value and the value corresponding to the gain.

Consequently, since the gain can be set in a desired manner with gain determination circuit 148, it is possible to set a desired gain with gain determination circuit 148, which can therefore set an optimum gain with respect the screen power value.

Moreover, the gain determined by gain determination circuit 148 in current limiting circuit 140 according to the present embodiment may be less than 1 when the screen power ratio is greater than the first power ratio which is less than the target power ratio.

Consequently, it is possible to more gently increase the gain in a range where the screen power ratio is greater than the first power ratio which is less than the target power ratio in the current limiting circuit according to the present embodiment than in the current limiting circuit of the comparative example. Thus, it is possible to bring the gamma characteristics provided in the large area video displaying even closer to the gamma characteristics provided in the small area video displaying.

Moreover, the inclination of the graph indicating the luminance with respect to the pixel values respectively corresponding to the plurality of pixels may be greater than zero with a desired pixel value in current limiting circuit 140 according to the present embodiment.

Moreover, display device 110 according to the present embodiment includes current limiting circuit 140 and display panel 160.

Since display device 110 according to the present embodiment includes current limiting circuit 140, it is possible to bring the gamma characteristics provided in the large area video displaying closer to the gamma characteristics provided in the small area video displaying.

Moreover, a current limiting method according to the present embodiment includes: power calculation for calculating a screen power value related to a power consumption value based on pixel values of a video signal respectively corresponding to a plurality of pixels; gain determination for determining a gain based on the screen power value; and gain multiplication for multiplying the pixel values respectively corresponding to the plurality of pixels by the gain. The gain determined in the gain determination is 1 when the screen power ratio is less than or equal to a first power ratio which is less than a target power ratio, and the aforementioned gain monotonously decreases with respect to the screen power ratio when the screen power ratio is greater than the first power ratio and less than or equal to 100%. The aforementioned gain is a value less than a value obtained by dividing the target power ratio by the screen power ratio when the screen power ratio is greater than or equal to the target power ratio and less than 100%, and the aforementioned gain is the target power ratio when the screen power ratio is 100%.

With the current limiting method having a configuration as described above, the same effects as those provided by current limiting circuit 140 are provided.

Embodiment 5

Next, a display device according to Embodiment 5 will be described. The present embodiment differs from Embodiment 4 in gamma characteristics of a display panel used. Hereinafter, the display device according to the present embodiment will be described focusing on a difference from display device 110 according to Embodiment 4.

[5-1. Overall Configuration of Display Device]

First, the overall configuration of the display device according to the present embodiment will be described with reference to FIG. 20.

Figure 20:
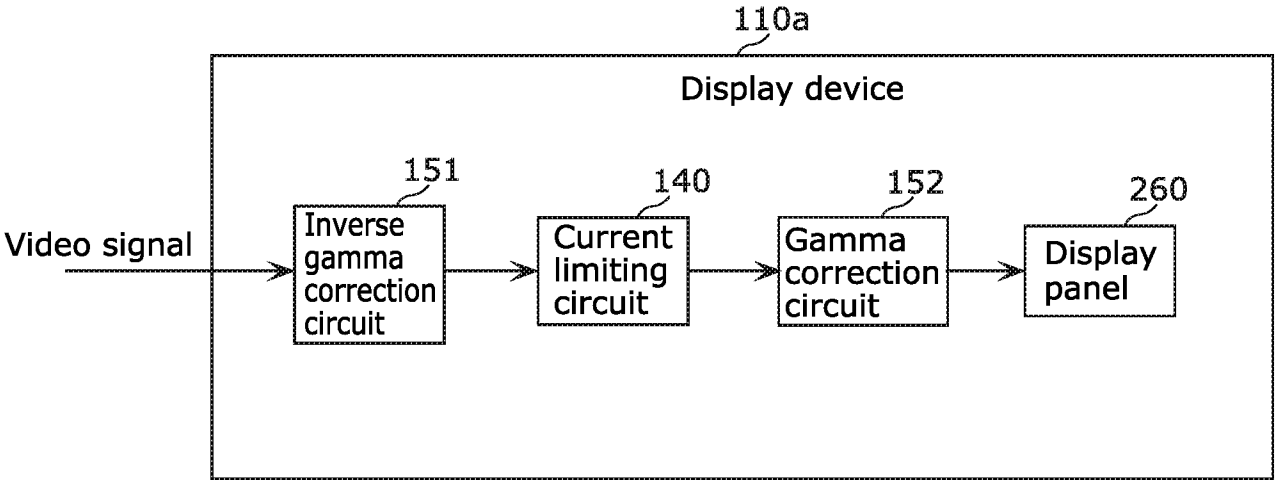
FIG. 20 is a block diagram illustrating a functional configuration of a display device according to Embodiment 5.

FIG. 20 is a block diagram illustrating a functional configuration of display device 110*a* according to the present embodiment.

Display device 110*a* illustrated in FIG. 20 is a device which displays a video based on a video signal and includes inverse gamma correction circuit 151, current limiting circuit 140, gamma correction circuit 152, and display panel 260.

Inverse gamma correction circuit 151 is a circuit which corrects a relation between pixel values included in the video signal and the luminance of each of sub-pixels included in display panel 260 to a proportional relation. In the present embodiment, inverse gamma correction circuit 151 converts the pixel values to thereby correct gamma characteristics such that the luminance is proportional to the power of 2.2 of the pixel value to gamma characteristics such that the luminance is proportional to the pixel value. Inverse gamma correction circuit 151 outputs the video signal including the converted pixel value to current limiting circuit 140.

Current limiting circuit 140 according to the present embodiment has the same configuration as that of current limiting circuit 140 according to Embodiment 4.

Gamma correction circuit 152 is a circuit which corrects the relation between the pixel values included in the video signal and the luminance of each of the sub-pixels included in display panel 260 from the proportional relation to a predetermined relation. In the present embodiment, gamma correction circuit 152 converts the pixel values to thereby correct the gamma characteristics such that the luminance is proportional to the pixel value to gamma characteristics such that the luminance is proportional to the power of 2.2 of the pixel value. Gamma correction circuit 152 outputs the video signal including the converted pixel value to display panel 260.

As described above, the use of inverse gamma correction circuit 151 and gamma correction circuit 152 makes it possible to use current limiting circuit 140 according to Embodiment 4 even upon the use of display panel 260 configured such that the luminance is proportional to the power of 2.2 of the pixel value.

Display panel 260 is a panel which has a plurality of pixels and which displays a video based on a video signal, as is the case with display panel 160 according to Embodiment 4. Each of the plurality of pixels has a plurality of sub-pixels, each of which includes a self-light-emitting element. Each of the plurality of pixels has three sub-pixels respectively corresponding to three colors RGB. In the present embodiment, display panel 260 is configured such that the luminance of each sub-pixel is proportional to the power of 2.2 of the pixel value inputted to each sub-pixel.

Display panel 260 is not specifically limited as long as a display panel is configured such that the luminance is proportional to approximately the power of 2.2 of the pixel value. For example, it is possible to use an organic EL display panel or the like as display panel 260. Hereinafter, a configuration of display panel 260 according to the present embodiment will be described with reference to FIG. 21.

Figure 21:
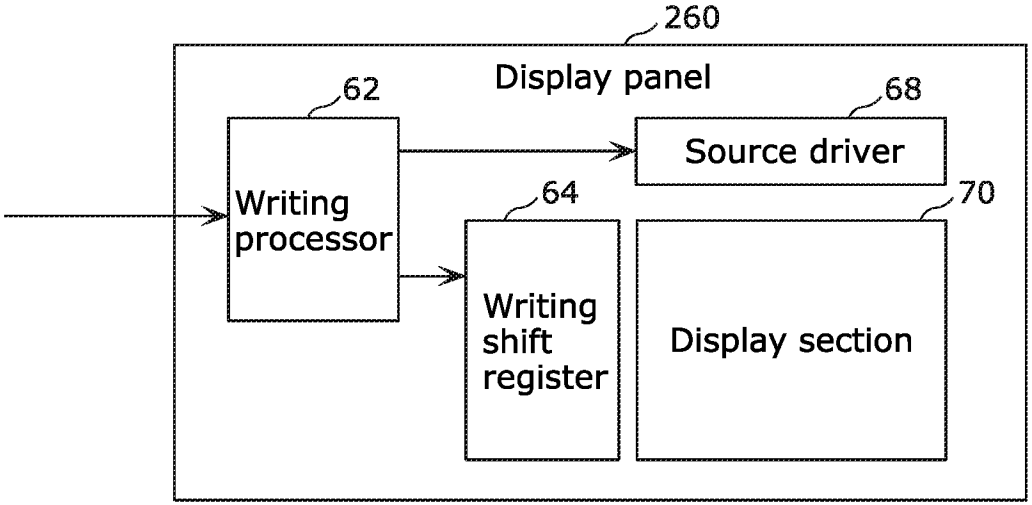
FIG. 21 is a block diagram illustrating a functional configuration of a display panel included in the display device according to Embodiment 5.

FIG. 21 is a block diagram illustrating a functional configuration of display panel 260 included in display device 110*a* according to the present embodiment.

As illustrated in FIG. 21, display panel 260 has display section 70, write processor 62, source driver 68, and writing shift register 64 as is the case with display panel 60 according to Embodiment 1. Display section 70 has a plurality of pixels and displays a video corresponding to a video signal. Write processor 62 outputs a control signal and a data signal for writing, into display section 70, a pixel value corresponding to display data. Source driver 68 outputs the data signal to display section 70. Writing shift register 64 outputs, to display section 70, a write signal as the control signal for writing the data signal into display section 70.

[5-2. Operation Example]

Next, the operation example of display device 110*a* according to the present embodiment will be described in comparison to the operation of the display device of the comparative example. A relation between the screen power value and the gain according to the present embodiment and the comparative example is a relation illustrated in FIG. 17, as is the case with Embodiment 4.

Figure 22:
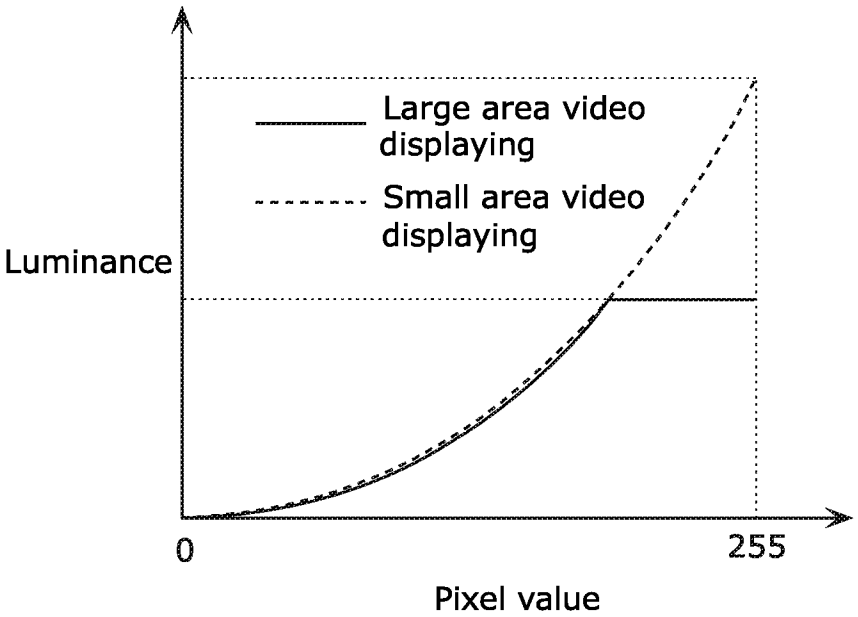
FIG. 22 is a graph illustrating gamma characteristics provided when the current limiting circuit of the comparative example is used.
Figure 23:
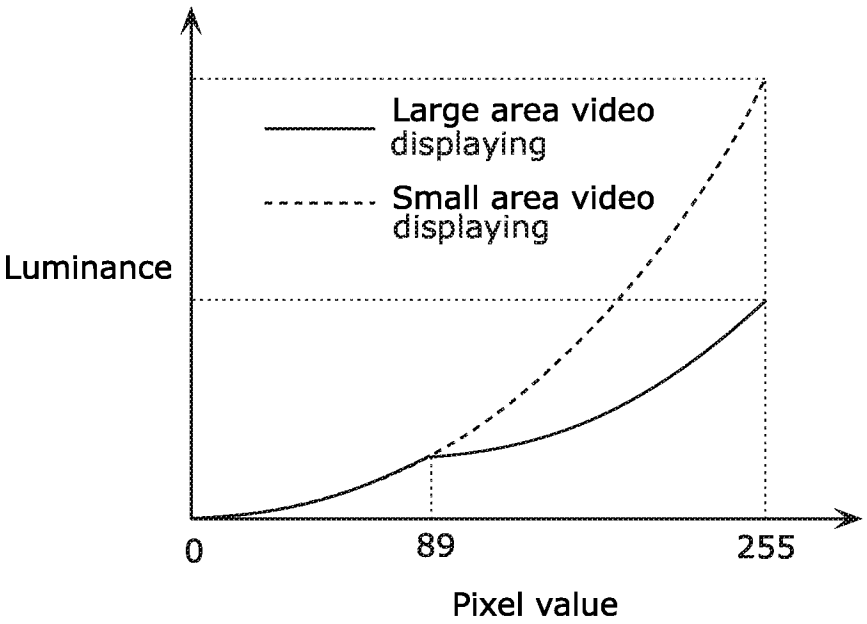
FIG. 23 is a graph illustrating gamma characteristics provided when a current limiting circuit according to Embodiment 5 is used.

Gamma characteristics provided when the current limiting circuit of the comparative example and current limiting circuit 140 according to the present embodiment as described above are used in the display device will be described with reference to FIGS. 22 and 23. FIGS. 22 and 23 are graphs respectively illustrating the gamma characteristics of display device 110*a* provided when the current limiting circuit of the comparative example and current limiting circuit 140 according to the present embodiment are used. A solid line and a broken line illustrated in FIGS. 22 and 23 respectively illustrate the gamma characteristics provided in the large area video displaying and the small area video displaying. FIGS. 22 and 23 illustrate, as one example of the large area video displaying, the gamma characteristics provided when white displaying is provided on all the pixels and also illustrate, as one example of the small area video displaying, the gamma characteristics provided when white displaying is provided on 10% of the pixels and black displaying is provided on the remaining 90% of the pixels. In the graphs of FIGS. 22 and 23, a horizontal axis represents a pixel value inputted to display device 110*a* (that is, the pixel value before subjected to inverse gamma correction) and a vertical axis represents the luminance of each pixel.

As illustrated in FIG. 22, the gamma is 1 in the small area video displaying in the current limiting circuit of the comparative example, which therefore provides the gamma characteristics such that the luminance is proportional to the power of 2.2 of the pixel value. On the other hand, in the large area video displaying, the gamma characteristics such that the luminance is proportional to the power of 2.2 of the pixel value are provided in a range where the pixel value is small while the luminance is constant in the range where the pixel value is close to the upper limit value (255). As described above, the gamma characteristics provided in the large area video displaying largely differs from the gamma characteristics such that the luminance is proportional to the power of 2.2 of the pixel value.

In current limiting circuit 140 according to the present embodiment, the gain determined by gain determination circuit 148 is 1 when the screen power ratio is less than or equal to 10%, and the aforementioned gain monotonously decreases with respect to the screen power ratio when the screen power value is greater than 10% and less than or equal to 100%. Moreover, the aforementioned gain is a value less than a value obtained by dividing the target power ratio by the screen power ratio when the screen power ratio is greater than or equal to the target power ratio and less than 100%, and the aforementioned gain is the target power ratio when the screen power ratio is 100%. In other words, the gain according to the present embodiment is less than or equal to the gain of the comparative example when the screen power ratio is greater than 10% and less than the target power ratio. The aforementioned gain according to the present embodiment is smaller than the gain of the comparative example when the screen power ratio is greater than or equal to the target power ratio and less than 100%. The aforementioned gain is the same as the gain of the comparative example when the screen power ratio is less than or equal to 10% and 100%.

The gamma characteristics of display device 110*a* provided when current limiting circuit 140 according to the present embodiment is used will be described with reference to FIG. 23.

As illustrated in FIG. 23, the gain is 1 in the small area video displaying, which therefore provides gamma characteristics such that the luminance is proportional to the power of 2.2 of the pixel value. Moreover, in the large area video displaying, gamma characteristics such that the luminance is proportional to the power of 2.2 of the pixel value are provided in a range where the pixel value is small (a range of 89 or less), and the inclination of the graph illustrating the luminance with respect to each of the pixel values of the plurality of pixels is greater than zero with the desired pixel value even in the range where the pixel value is close to the upper limit value (255) (a range greater than 89 and less than or equal to 255). More specifically, current limiting circuit 140 according to the present embodiment provides gamma characteristics indicated by a curve close to a curve proportional to the power of 2.2 of the pixel value even in the range where the pixel value is close to the upper limit value. That is, the use of the value Y obtained by normalizing the luminance by the maximum value and the value X obtained by normalizing the pixel value with the maximum value establishes Expression 8 below in the range where the pixel value is less than or equal to 89.

$$Y=a1\times X^{b1} \quad \text{(Expression 8).}$$

Moreover, Expression 9 below is established in a range where the pixel value is greater than 89.

$$Y=a2\times X^{b2} \quad \text{(Expression 9).}$$

Here, a1=1>a2=0.4>0 and b1=2.2>b2≈1.325>0 in the present embodiment.

As described above, with current limiting circuit 140 according to the present embodiment, it is possible to bring the gamma characteristics provided in the large area video displaying closer to the gamma characteristics provided in the small area video displaying.

Moreover, with current limiting circuit 140 according to the present embodiment, the gain is less than 1 when the screen power ratio is greater than 10%. Consequently, in the range where the screen power ratio is greater than 10%, it is possible to more gently increase the gain than in the current limiting circuit of the comparative example. Thus, it is possible to bring the gamma characteristics provided in the large area video displaying even closer to the gamma characteristics provided in the small area video displaying.

Note that the example where the target power ratio is 40% in current limiting circuit 140 according to the description of the present embodiment has been illustrated, but the target power ratio is not limited to 40% as long as the target power ratio is greater than 0% and less than 100%.

Moreover, with current limiting circuit 140 according to the present embodiment, the gain is 1 when the screen power ratio is less than or equal to 10%, but the numerical value 10% is merely one example of the first power ratio as a value less than the target power ratio. In other words, the first power ratio is not limited to 10% as long as the first power ratio is greater than 0% and less than the target power ratio.

Other Embodiments

The current limiting circuit, etc. according to the present disclosure have been described above based on each of the embodiments, but the current limiting circuit, etc. according to the present disclosure are not limited to the embodiments described above. The present disclosure also includes: another embodiment realized by combining together the desired components included in the embodiments; a variation obtained by making various modifications, conceivable by those skilled in the art, to the embodiments within a range not departing from the spirits of the present disclosure; and various devices having, for example, the current limiting circuit according to each of the embodiments built therein.

Figure 24:
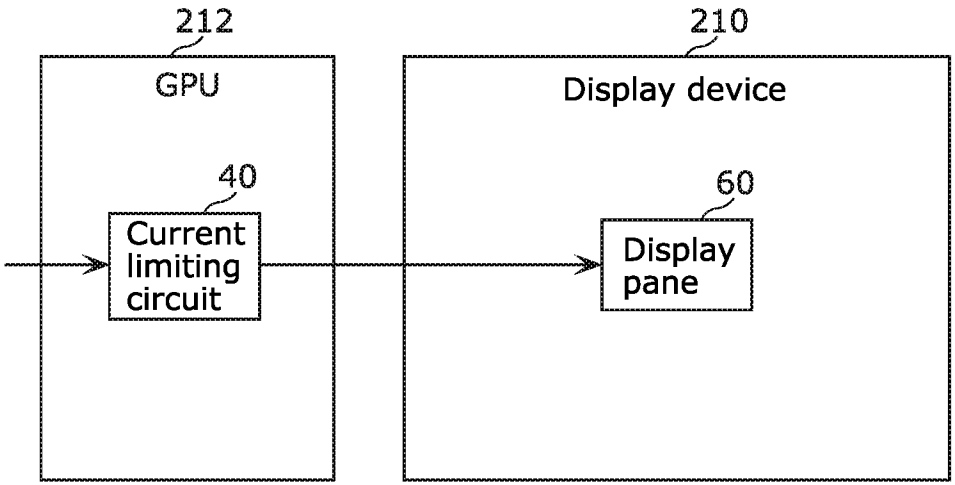
FIG. 24 is a block diagram illustrating a relation between a current limiting circuit and a display device according to a variation.
Figure 25:
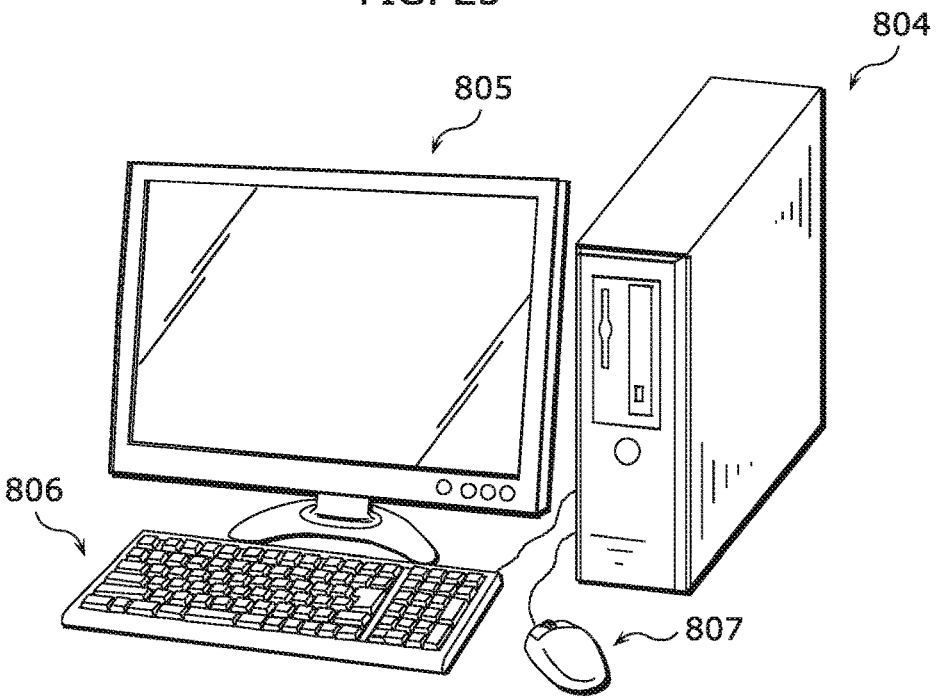
FIG. 25 is an outer view of a PC built in a processing circuit according to the variation.
Figure 26:
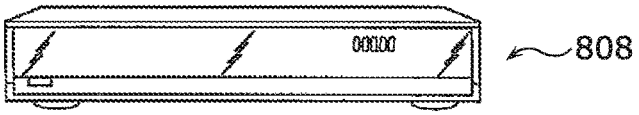
FIG. 26 is an outer view of a hard disc recorder built in the processing circuit according to the variation.

For example, the current limiting circuit includes the display device in the embodiments described above, but the current limiting circuit does not necessarily have to include the display device. Such a variation will be described with reference to FIG. 24. FIG. 24 is a block diagram illustrating a relation between current limiting circuit 40 and display device 210 according to the present variation. As illustrated in FIG. 24, current limiting circuit 40 is included in graphics processing unit (GPU) 212. GPU 212 is a calculation device for image processing, and receives a video signal and outputs the video signal processed by current limiting circuit 40. GPU 212 is arranged outside of display device 210 and outputs, to display device 210, the video signal processed by processing circuit 20. Note that current limiting circuit 40 is used in the example illustrated in FIG. 24 but current limiting circuit 140 may be used. For example, GPU 212 may be included in personal computer (PC) 804 as illustrated in FIG. 25. PC 804 is operated by keyboard 806, mouse 807, etc. Display device 210 may be included in monitor 805 illustrated in FIG. 25. Monitor 805 includes display device 210 and displays a video signal from PC 804. Moreover, GPU 212 may be included in hard disk recorder 808 as illustrated in FIG. 26.

Even when current limiting circuits 40 and 140 are not included in the display device as described above, the same effects as those provided by current limiting circuit 40 according to Embodiment 1 and current limiting circuit 140 according to Embodiment 4 described above are also provided.

Figure 27:
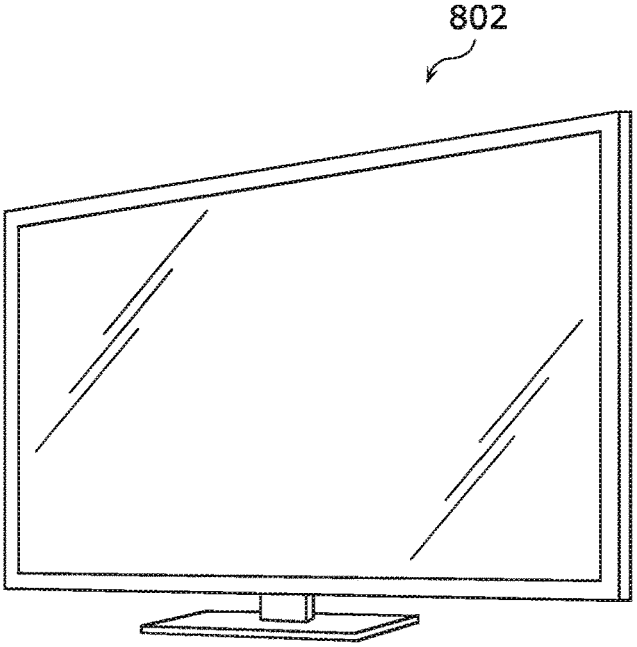
FIG. 27 is an outer view of a flat screen TV built in the display device according to each of the embodiments.

Moreover, the display device according to each of the embodiments described above may be built in flat screen TV 802 as illustrated in FIG. 27. Also in this case, the same effects as those provided in each of the embodiments described above are provided.

Moreover, for the purpose of simplifying the description, the example where the luminance is proportional to the pixel value inputted to current limiting circuit 140 has been illustrated in Embodiments 4 and 5 described above, but the luminance does not necessarily have to be proportional to the pixel value inputted to the current limiting circuit. For example, even when the luminance is proportional to the power of 2.2 of the pixel value inputted to the current limiting circuit, data included in LUT can be converted to thereby realize a current limiting circuit which provides the same effects as those provided by the current limiting circuit according to each of the embodiments.

Moreover, display panel 260 configured such that the luminance is proportional to the power of 2.2 of the pixel value is used in Embodiment 5 described above, but the display panel is not limited thereto. For example, an organic EL display panel configured such that the luminance is proportional to approximately greater than or equal to the power of 2.4 of the pixel value and less than or equal to the power of 2.6 of the pixel value may be used.

Moreover, illustrated in each of the embodiments described above is the configuration such that any of the pixels included in the display panel includes the three sub-pixels respectively corresponding to the three colors RGB, but the configuration of the pixel is not limited to the aforementioned configuration. For example, the pixel may include four sub-pixels respectively corresponding to four colors RGBW.

Moreover, the video signal in each of the embodiments described above is an RGB signal but the video signal may include a signal other than the RGB signal. That is, the video signal is only required to include the RGB signal.

Moreover, the example where an organic EL element and a discharge cell of a plasma display panel are used as a self-light-emitting element has been illustrated in each of the embodiments described above, but the self-light-emitting element is not limited to such a self-light-emitting element. For example, an inorganic EL element may be used as the self-light-emitting element.

Although only some exemplary embodiments of the present disclosure have been described in detail above, those skilled in the art will readily appreciate that many modifications are possible in the exemplary embodiments without materially departing from the novel teachings and advantages of the present disclosure. Accordingly, all such modifications are intended to be included within the scope of the present disclosure.

INDUSTRIAL APPLICABILITY

The present disclosure is useful for the organic EL flat panel display and particularly optimum for use in a large screen display which consumes great power.

The invention claimed is:

1. A current limiting circuit which limits a current supplied to a plurality of pixels included in a display panel, which displays a video based on a video signal, to control a power consumption value in the plurality of pixels to be less than or equal to a control target power value, each of the plurality of pixels including a plurality of sub-pixels, each of the plurality of sub-pixels including a self-light-emitting element, wherein the current limiting circuit comprises:

a gain calculation circuit which calculates a screen power value related to the power consumption value based on pixel values of the video signal respectively corresponding to the plurality of sub-pixels and calculates a gain based on the screen power value; and a gain multiplication circuit which multiplies the pixel values respectively corresponding to the plurality of sub-pixels by the gain, when a maximum value of the pixel values respectively corresponding to the plurality of sub-pixels in each of the plurality of pixels exceeds a first threshold value, the gain calculation circuit calculates the screen power value by use of a common pixel value greater than or equal to the maximum value instead of the pixel values respectively corresponding to the plurality of sub-pixels, and when the screen power value exceeds the control target power value, the gain calculation circuit sets the gain to a ratio of the control target power value with respect to the screen power value, and when the screen power value is less than or equal to the control target power value, the gain calculation circuit sets the gain to 1.

2. The current limiting circuit according to claim 1, wherein the first threshold value is a lower limit value of the pixel values.

3. The current limiting circuit according to claim 1, wherein the common pixel value is an upper limit value of the pixel values.

4. The current limiting circuit according to claim 1, wherein the first threshold value is a value greater than a lower limit value of the pixel values and less than an upper limit value of the pixel values.

5. A display device, comprising:

the current limiting circuit according to claim 1; and the display panel.

6. A current limiting method for limiting a current supplied to a plurality of pixels included in a display panel, which displays a video based on a video signal, to control a power consumption value in the plurality of pixels to be less than or equal to a control target power value, each of the plurality of pixels including a plurality of sub-pixels, each of the plurality of sub-pixels including a self-light-emitting element, wherein the current limiting method comprises:

power calculation for calculating a screen power value related to the power consumption value based on pixel values of the video signal respectively corresponding to the plurality of sub-pixels;

gain calculation for calculating a gain based on the screen power value; and gain multiplication for multiplying the pixel values respectively corresponding to the plurality of sub-pixels by the gain, in the power calculation, when a maximum value of the pixel values respectively corresponding to the plurality of sub-pixels in each of the plurality of pixels exceeds a first threshold value, instead of the pixel values respectively corresponding to the plurality of sub-pixels, a common pixel value greater than or equal to the maximum value is used to calculate the screen power value, and in the gain calculation, when the screen power value exceeds the control target power value, the gain is set to a ratio of the control target power value with respect to the screen power value, and when the screen power value is less than or equal to the control target power value, the gain is set to 1.

7. A current limiting circuit which limits a current supplied to a plurality of pixels included in a display panel, which displays a video based on a video signal, to control a power consumption value in the plurality of pixels to be less than or equal to a control target power value, each of the plurality of pixels including a self-light-emitting element, wherein the current limiting circuit comprises:

a gain determination circuit which calculates a screen power value related to the power consumption value based on pixel values of the video signal respectively corresponding to the plurality of pixels and determines a gain based on the screen power value; and a gain multiplication circuit which multiplies the pixel values respectively corresponding to the plurality of pixels by the gain, where the screen power value provided when a current corresponding to an upper limit value of the pixel values respectively corresponding to the plurality of pixels is supplied is defined as a rated power value, a ratio of the screen power value with respect to the rated power value is defined as a screen power ratio, and a ratio of the control target power value with respect to the rated power value is defined as a target power ratio, the gain determined by the gain determination circuit is 1 when the screen power ratio is less than or equal to a first power ratio less than the target power ratio, the gain monotonously decreases with respect to the screen power ratio when the screen power ratio is greater than the first power ratio and less than or equal to 100%, the gain is a value less than a value obtained by dividing the target power ratio by the screen power ratio when the screen power ratio is greater than or equal to the target power ratio and less than 100%, and the gain is the target power ratio when the screen power ratio is 100%.

8. The current limiting circuit according to claim 7, wherein between a value X obtained by normalizing the pixel values by a maximum value of the pixel values and a value Y obtained by normalizing luminance of each of the plurality of pixels corresponding to the pixel value by a maximum value of the luminance, $Y=a1\times X^{b1}$ is established in a range where the pixel value is less than or equal to a predefined first value, $Y=a2\times X^{b2}$ is established in a range where the pixel value is greater than a predetermined value, and $a1>a2>0$ and $b1>b2>0$ are further established.

9. The current limiting circuit according to claim 7, wherein $G=a\times P^{b-1}$ ($0<a<1$ and $b<1$) is established between G as the gain and P as the screen power ratio in at least part of a range where the screen power ratio is greater than a predefined second value.

10. The current limiting circuit according to claim 7, wherein the gain determination circuit has a lookup table indicating a relation between a value corresponding to the screen power value and a value corresponding to the gain.

11. The current limiting circuit according to claim 7, wherein the gain determined by the gain determination circuit is less than 1 when the screen power ratio is greater than the first power ratio.

12. The current limiting circuit according to claim 7, wherein inclination of a graph indicating luminance with respect to the pixel value of each of the plurality of pixels is greater than zero with the pixel value given.

13. A display device, comprising:

the current limiting circuit according to claim 7; and the display panel.

14. A current limiting method for limiting a current supplied to a plurality of pixels included in a display panel, which displays a video based on a video signal, to control a power consumption value in the plurality of pixels to be less than or equal to a control target power value, each of the plurality of pixels including a self-light-emitting element, wherein the current limiting method comprises:

power calculation for calculating a screen power value related to the power consumption value based on pixel values of the video signal respectively corresponding to the plurality of pixels;

gain determination for determining a gain based on the screen power value; and gain multiplication for multiplying the pixel values respectively corresponding to the plurality of pixels by the gain, where the screen power value provided when a current corresponding to an upper limit value of the pixel values respectively corresponding to the plurality of pixels is defined as a rated power value, a ratio of the screen power value with respect to the rated power value is defined as a screen power ratio, and a ratio of the control target power value with respect to the rated power value is defined as a target power ratio, the gain determined in the gain determination is 1 when the screen power ratio is less than or equal to a first power ratio less than the target power ratio, the gain monotonously decreases with respect to the screen power ratio when the screen power ratio is greater than the first power ratio and less than or equal to 100%, the gain is a value less than a value obtained by dividing the target power ratio by the screen power ratio when the screen power ratio is greater than or equal to the target power ratio and less than 100%, and the gain is the target power ratio when the screen power ratio is 100%.

* * * * *